US011482148B2

(12) United States Patent
Zhu et al.

(10) Patent No.: US 11,482,148 B2
(45) Date of Patent: Oct. 25, 2022

(54) POWER SUPPLY TIME SEQUENCE CONTROL CIRCUIT AND CONTROL METHOD THEREOF, DISPLAY DRIVER CIRCUIT, AND DISPLAY DEVICE

(71) Applicants: HEFEI XINSHENG OPTOELECTRONICS TECHNOLOGY CO., LTD., Anhui (CN); BOE TECHNOLOGY GROUP CO., LTD., Beijing (CN)

(72) Inventors: Lixin Zhu, Beijing (CN); Chunyang Nie, Beijing (CN)

(73) Assignees: HEFEI XINSHENG OPTOELECTRONICS TECHNOLOGY CO., LTD, Anhui (CN); Beijing BOE Technology Development Co., Ltd., Beijing (CN)

( * ) Notice: Subject to any disclaimer, the term of this patent is extended or adjusted under 35 U.S.C. 154(b) by 317 days.

(21) Appl. No.: 16/605,217

(22) PCT Filed: Mar. 28, 2019

(86) PCT No.: PCT/CN2019/080188
§ 371 (c)(1),
(2) Date: Oct. 15, 2019

(87) PCT Pub. No.: WO2019/228045
PCT Pub. Date: Dec. 5, 2019

(65) Prior Publication Data

US 2021/0335179 A1 Oct. 28, 2021

(30) Foreign Application Priority Data

May 28, 2018 (CN) ..... 201810523586.8

(51) Int. Cl.
*G09G 3/20* (2006.01)

(52) U.S. Cl.
CPC ..... *G09G 3/20* (2013.01); *G09G 2310/08* (2013.01); *G09G 2330/028* (2013.01)

(58) Field of Classification Search
CPC ..... G09G 3/20; G09G 2330/028; G09G 2310/08; G09G 2330/026; G09G 3/2092
See application file for complete search history.

(56) References Cited

U.S. PATENT DOCUMENTS 6,097,616 A * 8/2000 Iwasaki ..... G03G 15/5004 363/97
9,535,478 B2 * 1/2017 Ochiai ..... G06F 1/26
(Continued)

FOREIGN PATENT DOCUMENTS

CN 101377907 A 3/2009
CN 101620828 A 1/2010
(Continued)

*Primary Examiner* — Grant Sitta
(74) *Attorney, Agent, or Firm* — Dave Law Group LLC; Raj S. Dave

(57) ABSTRACT

A power supply time sequence control circuit and a control method thereof, a display driver circuit, and a display device. The power supply time sequence control circuit includes: a delay control sub-circuit, a delay detection sub-circuit and an output sub-circuit. The delay control sub-circuit is configured to receive a first voltage outputted by the first input voltage terminal and to output the first voltage after delaying for a pre-determined time period; the delay detection sub-circuit is configured to send a trigger signal to the output sub-circuit upon the first voltage being received by the delay detection sub-circuit; the output sub-circuit is configured to be in an on-state in response to the trigger signal, so as to output the first voltage provided by the first input voltage terminal to the signal output terminal, and to enable the signal output terminal to output the first voltage.

18 Claims, 8 Drawing Sheets

(56) References Cited

U.S. PATENT DOCUMENTS

2003/0034965 A1 2/2003 Kim
2003/0184538 A1* 10/2003 Yamato ..... G09G 3/3696 345/211
2008/0049473 A1* 2/2008 Sugahara ..... H02M 3/156 363/84
2009/0058311 A1* 3/2009 Eom ..... G09G 3/3208 315/173
2009/0106574 A1* 4/2009 Xiong ..... G06F 1/26 713/340
2009/0207192 A1 8/2009 Hashimoto
2010/0091000 A1* 4/2010 Lee ..... G09G 3/3696 345/87
2010/0134474 A1* 6/2010 Watanabe ..... G11C 19/28 345/213
2010/0223485 A1* 9/2010 Zou ..... G06F 1/26 713/340
2011/0187337 A1* 8/2011 Lin ..... G05F 1/10 323/282
2011/0317317 A1* 12/2011 Liu ..... H03K 17/284 361/56
2013/0113777 A1* 5/2013 Baek ..... G09G 5/008 345/212
2014/0062447 A1* 3/2014 Chen ..... G09G 3/20 323/311
2016/0011612 A1* 1/2016 Park ..... G09G 3/3233 323/280
2016/0379554 A1* 12/2016 Zhang ..... G09G 3/3208 315/158
2017/0243541 A1* 8/2017 Tan ..... G09G 3/3258
2017/0264200 A1* 9/2017 Naito ..... H02M 3/158
2017/0278454 A1* 9/2017 Zhang ..... H05B 45/60
2018/0166027 A1* 6/2018 Cao ..... H02H 9/005
2018/0212513 A1* 7/2018 Park ..... H02M 3/156
2018/0218675 A1* 8/2018 Zhang ..... H01L 27/3276
2018/0233078 A1* 8/2018 Park ..... H02M 1/36
2019/0121476 A1* 4/2019 Jang ..... G06F 3/0412
2020/0267344 A1* 8/2020 Li ..... H02M 1/36
2021/0210015 A1* 7/2021 Han ..... G09G 3/3208

FOREIGN PATENT DOCUMENTS

CN 105469742 A 4/2016
CN 106128389 A 11/2016
CN 207337882 U 5/2018

* cited by examiner

POWER SUPPLY TIME SEQUENCE CONTROL CIRCUIT AND CONTROL METHOD THEREOF, DISPLAY DRIVER CIRCUIT, AND DISPLAY DEVICE

CROSS-REFERENCE

The present application is the U.S. national stage of International Patent Application No. PCT/CN2019/080188, Mar. 28, 2019, which claims priority to Chinese patent application No. 201810523586.8, filed on May 28, 2018, the entire disclosures of which are incorporated herein by reference as part of the present application.

TECHNICAL FIELD

Embodiments of the present disclosure relate to a display technology field, especially relate to a power supply time sequence control circuit and a control method thereof, a display driver circuit, and a display device.

BACKGROUND

A display device, for example, can be a liquid crystal display device (TFT-LCD) or an organic light emitting diode (OLED) display device. The display device includes a display area for displaying an image and a wiring area located on the periphery of the display area. The wiring area is provided with, for example, a plurality of driving circuits for driving the display area to display an image.

SUMMARY

At least one embodiment of the present disclosure provides a power supply time sequence control circuit, which includes: a delay control sub-circuit, a delay detection sub-circuit and an output sub-circuit. The delay control sub-circuit is electrically connected with a first input voltage terminal, and the delay control sub-circuit is configured to receive a first voltage outputted by the first input voltage terminal, and to output the first voltage after delaying for a pre-determined time period; the delay detection sub-circuit is electrically connected with the delay control sub-circuit and the output sub-circuit, and the delay detection sub-circuit is configured to send a trigger signal to the output sub-circuit upon the first voltage being received by the delay detection sub-circuit; and the output sub-circuit is further electrically connected with the first input voltage terminal and a signal output terminal, and the output sub-circuit is configured to be in an on-state in response to the trigger signal, so as to output the first voltage provided by the first input voltage terminal to the signal output terminal, and to enable the signal output terminal to output the first voltage.

For example, in at least one example of the power supply time sequence control circuit, the power supply time sequence control circuit further includes an auxiliary output sub-circuit; the auxiliary output sub-circuit is electrically connected with the output sub-circuit; the auxiliary output sub-circuit is configured to allow the output sub-circuit to be kept in an on-state after the trigger signal is received by the output sub-circuit; and the output sub-circuit is configured to continuously output the first voltage to the signal output terminal after receiving the trigger signal, so as to enable the signal output terminal to continuously output the first voltage.

For example, in at least one example of the power supply time sequence control circuit, the auxiliary output sub-circuit is further electrically connected with the first input voltage terminal, a first reference voltage terminal, a second input voltage terminal, a second reference voltage terminal and a third reference voltage terminal; the auxiliary output sub-circuit includes a power supply isolator, and the power supply isolator includes a first input terminal, a second input terminal, a first output terminal and a second output terminal; the first input terminal of the power supply isolator is electrically connected with the first input voltage terminal; the second input terminal of the power supply isolator is electrically connected with the first reference voltage terminal and the third reference voltage terminal; the first output terminal of the power supply isolator is electrically connected with the second input voltage terminal; the second output terminal of the power supply isolator is electrically connected with the second reference voltage terminal; and the power supply isolator is configured to, based on the first voltage provided by the first input voltage terminal, a first reference voltage provided by the first reference voltage terminal and a third reference voltage provided by the third reference voltage terminal, output a second voltage that is isolated from the first voltage to the second input voltage terminal, wherein the first reference voltage is different from a second reference voltage outputted by the second reference voltage terminal.

For example, in at least one example of the power supply time sequence control circuit, the power supply isolator is further configured to output the second reference voltage based on the first voltage, the first reference voltage and the third reference voltage, and the second reference voltage is isolated from the first reference voltage to the second reference voltage terminal.

For example, in at least one example of the power supply time sequence control circuit, the auxiliary output sub-circuit further includes a first capacitor, a second capacitor, a third capacitor, and a fourth capacitor; two terminals of the first capacitor are electrically connected with the first input voltage terminal and the first reference voltage terminal, respectively; two terminals of the second capacitor are electrically connected with the first input terminal of the power supply isolator and the second input terminal of the power supply isolator, respectively; two terminals of the third capacitor are electrically connected with the first output terminal of the power supply isolator and the second output terminal of the power supply isolator, respectively; and two terminals of the fourth capacitor are electrically connected with the second input voltage terminal and the second reference voltage terminal, respectively.

For example, in at least one example of the power supply time sequence control circuit, the auxiliary output sub-circuit further includes a fifth capacitor, a sixth capacitor, a seventh capacitor, and an eighth capacitor; two terminals of the fifth capacitor are electrically connected with the first input terminal of the power supply isolator and the third reference voltage terminal, respectively; two terminals of the sixth capacitor are electrically connected with the second input terminal of the power supply isolator and the third reference voltage terminal, respectively; two terminals of the seventh capacitor are electrically connected with the first output terminal of the power supply isolator and the third reference voltage terminal, respectively; and two terminals of the eighth capacitor are electrically connected with the second output terminal of the power supply isolator and the third reference voltage terminal, respectively.

For example, in at least one example of the power supply time sequence control circuit, the auxiliary output sub-circuit further includes a first resistor and a second resistor;

two terminals of the first resistor are electrically connected with the second input voltage terminal and the second reference voltage terminal, respectively; and the second resistor and the first resistor are in parallel connection, and two terminals of the second resistor are electrically connected with the second input voltage terminal and the second reference voltage terminal, respectively.

For example, in at least one example of the power supply time sequence control circuit, the output sub-circuit includes a switching transistor and a driving transistor; a gate electrode of the switching transistor is electrically connected with the delay detection sub-circuit, so as to receive the trigger signal; a gate electrode of the driving transistor is electrically connected with a second electrode of the switching transistor; a first electrode of the driving transistor is electrically connected with the first input voltage terminal, so as to receive the first voltage provided by the first input voltage terminal; a second electrode of the driving transistor is electrically connected with the signal output terminal; the driving transistor is configured to provide the first voltage provided by the first input voltage terminal to the second electrode of the driving transistor in response to the trigger signal; and the signal output terminal is configured to allow the first voltage at the second electrode of the driving transistor to be outputted from the signal output terminal.

For example, in at least one example of the power supply time sequence control circuit, the power supply time sequence control circuit further includes an auxiliary output sub-circuit. The auxiliary output sub-circuit is electrically connected with the output sub-circuit; the auxiliary output sub-circuit is further electrically connected with a second input voltage terminal and a second reference voltage terminal; a first electrode of the switching transistor is electrically connected with the second input voltage terminal, so as to receive a second voltage that is isolated from the first voltage and is provided by the second input voltage terminal; the second electrode of the switching transistor is electrically connected with the second reference voltage terminal, so as to receive a second reference voltage that is isolated from a first reference voltage and is provided by the second reference voltage terminal; and the second electrode of the driving transistor is further electrically connected with the second reference voltage terminal.

For example, in at least one example of the power supply time sequence control circuit, the output sub-circuit further includes: a third resistor, a fourth resistor and a fifth resistor; two terminals of the third resistor are electrically connected with the second input voltage terminal and an output terminal of the delay detection sub-circuit, respectively; two terminals of the fourth resistor are electrically connected with the output terminal of the delay detection sub-circuit and the gate electrode of the switching transistor, respectively; and two terminals of the fifth resistor are electrically connected with the second electrode of the switching transistor and the second reference voltage terminal, respectively.

For example, in at least one example of the power supply time sequence control circuit, the delay control sub-circuit is electrically connected with a first reference voltage terminal; the delay control sub-circuit includes an adjustable resistor and a ninth capacitor; a first terminal of the adjustable resistor is electrically connected with the first input voltage terminal, and a second terminal of the adjustable resistor is electrically connected with a first terminal of the ninth capacitor; and a second terminal of the ninth capacitor is electrically connected with the first reference voltage terminal.

For example, in at least one example of the power supply time sequence control circuit, an adjustment range of the adjustable resistor is 1 kΩ~10 MΩ.

For example, in at least one example of the power supply time sequence control circuit, the delay detection sub-circuit is further electrically connected with a first reference voltage terminal; the delay detection sub-circuit includes a comparator, a sixth resistor, a seventh resistor, an eighth resistor and a tenth capacitor; a positive input terminal of the comparator is electrically connected with the delay control sub-circuit, a negative input terminal of the comparator is electrically connected with a first terminal of the eighth resistor, and an output terminal of the comparator is electrically connected with the output sub-circuit; a second terminal of the eighth resistor is electrically connected with a first terminal of the sixth resistor and a first terminal of the seventh resistor; a second terminal of the sixth resistor is electrically connected with the first input voltage terminal; a second terminal of the seventh resistor is electrically connected with the first reference voltage terminal; two terminals of the tenth capacitor are electrically connected with the first reference voltage terminal and the first input voltage terminal.

At least one embodiment of the present application further provides a display driver circuit, which includes any one of the power supply time sequence control circuits provided by the embodiments of the present disclosure.

For example, in at least one example of the display driver circuit, the display driver circuit further includes a power management chip; the power management chip includes an input terminal and a plurality of voltage output terminals; the power management chip is configured to generate a plurality of output voltages based on an initial voltage received by the input terminal; the plurality of voltage output terminals are configured to output a plurality of output voltages, respectively; and one of the plurality of voltage output terminals of the power management chip is electrically connected with the first input voltage terminal of the power supply time sequence control circuit.

For example, in at least one example of the display driver circuit, the display driver circuit includes a plurality of power supply time sequence control circuits; the plurality of voltage output terminals of the power management chip are electrically connected with first input voltage terminals of the plurality of power supply time sequence control circuits, respectively, so as to provide the plurality of output voltages to the first input voltage terminals of the plurality of power supply time sequence control circuit, respectively; and the plurality of power supply time sequence control circuits are configured to control power supply time sequences of the plurality of output voltages.

For example, in at least one example of the display driver circuit, the display driver circuit further includes a timing controller, a source driver and a gate driver; the signal output terminal of the power supply time sequence control circuit is electrically connected with one selected from the group consisting of the timing controller, the source driver or the gate driver; and the timing controller, the source driver or the gate driver is further electrically connected with a first reference voltage terminal.

For example, in at least one example of the display driver circuit, the display driver circuit further includes a source driver, and a gray scale voltage generator that is configured to generate a plurality of gray scale reference voltages; the gray scale voltage generator includes a plurality of gray scale reference output terminals, and each of the gray scale reference output terminals is configured to output one of the plurality of gray scale reference voltages; one of the plurality of gray scale reference output terminals of the gray scale voltage generator is electrically connected with the first input voltage terminal of the power supply time sequence control circuit; the signal output terminal of the power supply time sequence control circuit is electrically connected with the source driver; and the source driver is further electrically connected with a first reference voltage terminal.

At least one embodiment of the present application further provides a display device, which includes any one of the display driver circuits provided by the embodiments of the present disclosure.

For example, in at least one example of display device, the display device further includes a display panel, and the display panel includes a common electrode layer; the first input voltage terminal of the power supply time sequence control circuit is electrically connected with a voltage output terminal, that is configured to output a common voltage, of the power management chip; and the signal output terminal of the power supply time sequence control circuit is electrically connected with the common electrode layer.

At least one embodiment of the present application further provides a method of controlling the power supply time sequence control circuit provided by the any one of the embodiments of the present disclosure, which includes: outputting, by the delay control sub-circuit, the first voltage outputted by the first input voltage terminal after delaying for the pre-determined time period; sending, by the delay detection sub-circuit, the trigger signal to the output sub-circuit upon the first voltage being received by the delay detection sub-circuit; allowing the output sub-circuit to be in an on-state in response to the trigger signal, and outputting, by the output sub-circuit, the first voltage provided by the first input voltage terminal to the signal output terminal.

For example, in at least one example of the method, in a case where the power supply time sequence control circuit further includes an auxiliary output sub-circuit, the output sub-circuit is configured to be in an on-state in response to the trigger signal, so as to output the first voltage provided by the first input voltage terminal to the signal output terminal, after outputting the first voltage to the signal output terminal, the method further includes: controlling, by the auxiliary output sub-circuit, the output sub-circuit to allow the output sub-circuit to be kept in an on-state after the trigger signal is received by the output sub-circuit.

BRIEF DESCRIPTION OF THE DRAWINGS

In order to clearly illustrate the technical solution of the embodiments of the disclosure, the drawings of the embodiments will be briefly described in the following; it is obvious that the described drawings are only related to some embodiments of the disclosure and thus are not limitative of the disclosure.

DETAILED DESCRIPTION

In order to make objects, technical details and advantages of the embodiments of the disclosure apparent, the technical solutions of the embodiments will be described in a clearly and fully understandable way in connection with the drawings related to the embodiments of the disclosure. Apparently, the described embodiments are just a part but not all of the embodiments of the disclosure. Based on the described embodiments herein, those skilled in the art can obtain other embodiment(s), without any inventive work, which should be within the scope of the disclosure.

Unless otherwise defined, all the technical and scientific terms used herein have the same meanings as commonly understood by one of ordinary skill in the art to which the present disclosure belongs. The terms "first," "second," etc., which are used in the description and the claims of the present application for disclosure, are not intended to indicate any sequence, amount or importance, but distinguish various components. Also, the terms such as "a," "an," etc., are not intended to limit the amount, but indicate the existence of at least one. The terms "comprise," "comprising," "include," "including," etc., are intended to specify that the elements or the objects stated before these terms encompass the elements or the objects and equivalents thereof listed after these terms, but do not preclude the other elements or objects. The phrases "connect", "connected", etc., are not intended to define a physical connection or mechanical connection, but may include an electrical connection, directly or indirectly. "On," "under," "right," "left" and the like are only used to indicate relative position relationship, and when the position of the object which is described is changed, the relative position relationship may be changed accordingly.

The inventors of the present disclosure have noted in research that, even though the power supply time sequence of the driving circuit of the display device can be controlled by codes, however, the codes may have bugs, and thus a deviation between an actual power supply time sequence and a pre-determined power supply time sequence may be caused, such that display abnormality may occur.

At least one embodiment of the present disclosure provides a power supply time sequence control circuit 01, and the power supply time sequence control circuit 01 can serve as a component of a display device, so as to control the power sequence or the power supply time sequence of a display panel. For example, the power supply time sequence control circuit 01 can control the power sequence of the display panel via pure hardware, and therefore, as compared with controlling the power sequence of the display panel by codes, the power supply time sequence control circuit 01 can control the power sequence of the display panel more precisely, such that potential display defects caused by abnormality of the power sequence of the display panel can be avoided.

Figure 1:
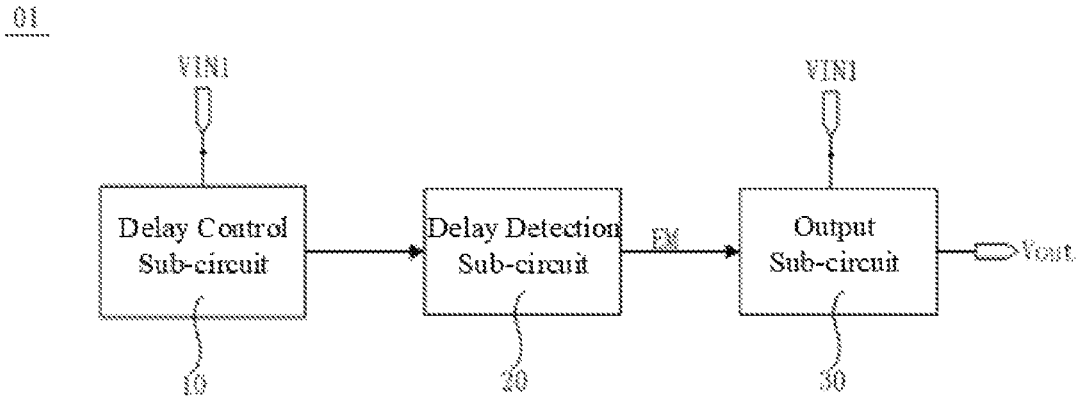
FIG. 1 is an exemplary block diagram of a power supply time sequence control circuit provided by at least one embodiment of the present disclosure.

FIG. 1 is an exemplary block diagram of the power supply time sequence control circuit 01 provided by at least one embodiment of the present disclosure. As illustrated in FIG. 1, the power supply time sequence control circuit 01 can include a delay control sub-circuit 10, a delay detection sub-circuit 20 and an output sub-circuit 30. As illustrated in FIG. 1, the power supply time sequence control circuit 01 includes a first input voltage terminal VIN1 and a signal output terminal Vout.

As illustrated in FIG. 1, the delay control sub-circuit 10 is electrically connected with the first input voltage terminal VIN1, so as to receive a first voltage V1 outputted by the first input voltage terminal VIN1. The delay control sub-circuit 10 is configured to output the first voltage V1 outputted by the first input voltage terminal VIN1 after delaying for a pre-determined time period T.

It should be noted that, outputting the first voltage V1 after delaying for a pre-determined time period T means that the voltage outputted by the delay control sub-circuit 10 is substantially equal to the first voltage V1 at a time point that the pre-determined time period T elapses with respect to a time point at which the delay control sub-circuit 10 receives the first voltage V1 (for example, the delay control sub-circuit 10 receives the first voltage V1 at time point T0, the voltage outputted by the delay control sub-circuit 10 is substantially equal to the first voltage V1 at time point T0+T). For example, during the time period between the time point T0 and the time point T0+T, the delay control sub-circuit 10 can also output a voltage, but the voltage value of the voltage being outputted is less than that of the first voltage V1. For the sake of clarity, a specific circuit structure of the delay control sub-circuit 10 will be described in detail after the output sub-circuit 30 is described, and no further description will be given here.

It should be noted that, the above-mentioned first voltage V1 can be provided by, for example, a power management circuit, and can be any one of the driving voltages (for example, any one of a digital operating voltage DVDD, an analog voltage AVDD, a gate turn-off voltage VGL, and a gate turn-on voltage VGH) that are configured to be provided to the display panel. For example, in the display device including the power supply time sequence control circuit 01, the above-mentioned first voltage V1 can be an analog voltage AVDD or a digital voltage DVDD (which is also referred to as a digital operating voltage) that is configured to be provided to a source driver. Furthermore, the above-mentioned first voltage V1 can also be a first operating voltage VGH or a second operating voltage VGL that is configured to be provided to a gate driver. Here, the voltage value of the first operating voltage VGH is greater than the voltage value of the second operating voltage VGL. For another example, the first voltage V1 can also be a gray scale reference voltage VGMA that is provided to the source driver, a digital voltage DVDD that is provided to the gate driver, or a common voltage Vcom that is provided to a common electrode layer of the display panel.

In an example, the power supply time point (for example, the end point of a rising edge or a falling edge) of at least one driving voltage provided by the power management circuit is deviated from a pre-determined power supply time point (that is, abnormality is present in the power sequence), and thus the power supply time sequence of the display panel does not satisfy actual application requirements; in this case, any voltage, that needs to be controlled (or adjusted), among the above-mentioned driving voltages, can be provided to the power supply time sequence control circuit 01 as the first voltage V1, and the delay control sub-circuit 10 and the power supply time sequence control circuit 01 are adopted to output the first voltage V1 (that is, the voltage that needs to be controlled or adjusted) after delaying for the pre-determined time period T, so as to allow the time sequence of the driving voltages provided to the display panel to satisfy actual application requirements, such that the power sequence of the display panel can be controlled more accurately, and potential display defects caused by abnormality of the power sequence of the display panel can be avoided.

Figure 10:
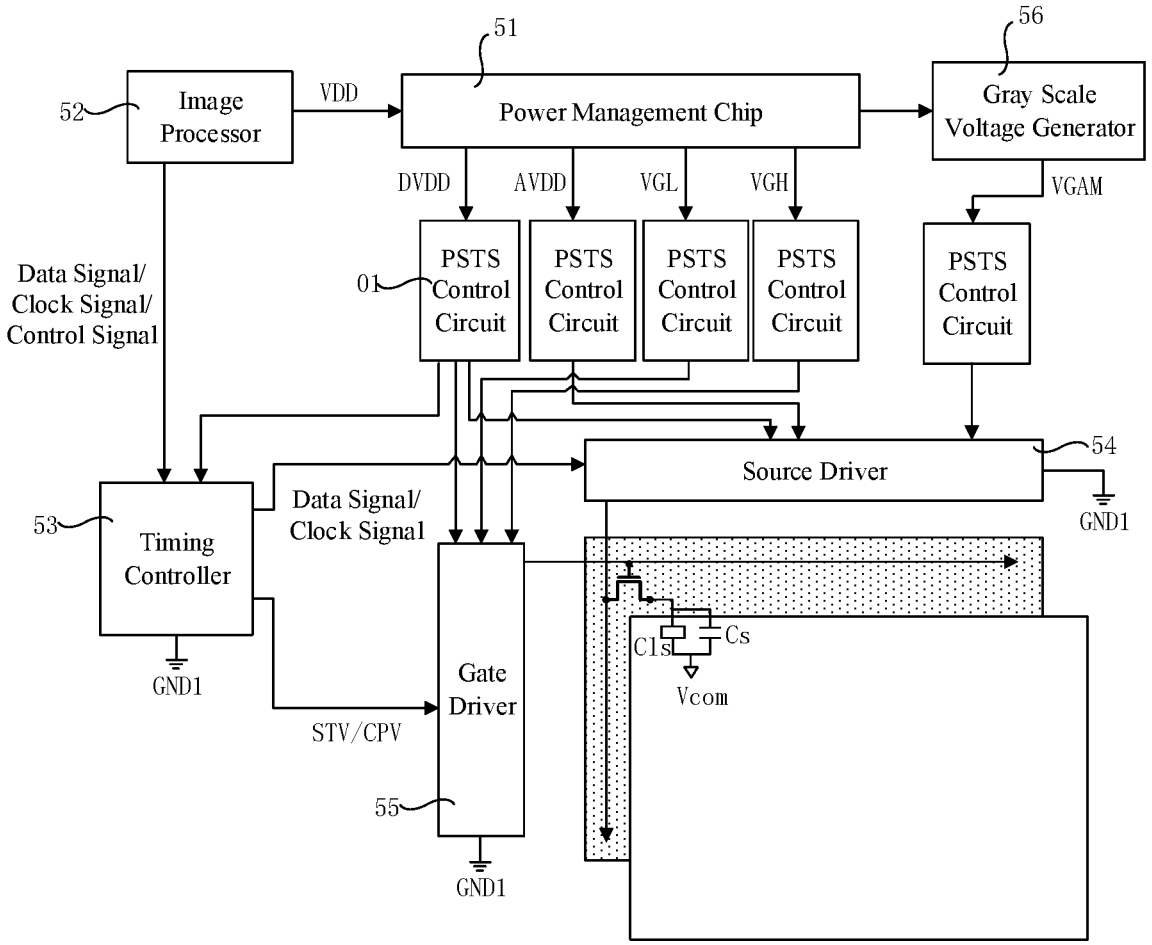
FIG. 10 is a schematic structural diagram of a display device provided by at least one embodiment of the present disclosure.

Embodiments of the present disclosure further provides a display driver circuit, which includes at least one of the above-mentioned power supply time sequence control circuit 01. Some embodiment of the present disclosure further provides a display device. FIG. 10 is a schematic structural diagram of a display device provided by the embodiments of the present disclosure. The display device includes a display driver circuit and a display panel. As illustrated in FIG. 10, the display driver circuit includes a plurality of power supply time sequence control circuits 01. As illustrated in FIG. 10, the above-mentioned display driver circuit further includes a power management chip 51 (or other applicable power management circuit). The power management chip 51 includes a plurality of voltage output terminals, and the power management chip is configured to generate a plurality of output voltages (for example, a digital operating voltage DVDD, an analog voltage AVDD, a gate turn-off voltage VGL, a gate turn-on voltage VGH) based on an initial voltage VDD (for example, 5 volts or 12 volts) received by an input terminal, and the plurality of output voltages are outputted by different voltage output terminals. It should be noted that, the display driver circuit can also include only one or two power supply time sequence control circuits 01.

For example, as illustrated in FIG. 10, an image processor (or an interface connector) 52 can be configured to provide the initial voltage VDD to the above-mentioned power management chip 51.

For example, each of the voltage output terminals of the above-mentioned power management chip 51 is electrically connected with the first input voltage terminal VIN1 of one of the power supply time sequence control circuits 01. For example, there is a one-to-one correspondence between the plurality of voltage output terminals of the power management chips 51 and the plurality of power supply time sequence control circuits 01; the plurality of voltage output terminals of the power management chips 51 are electrically connected with the first input voltage terminals VIN1 of the plurality of power supply time sequence control circuits 01, respectively, such that the plurality of output voltages outputted by the power management chip are provided to corresponding power supply time sequence control circuits 01, respectively.

For example, the power supply time sequence control circuits 01 connected with the power management chip 51 can sequentially output the plurality of output voltages (or the driving voltages, for example, DVDD, AVDD, VGL and VGH) generated by the power management chip 51 to corresponding loads according to a pre-determined power supply time sequence as needed. For example, the above-mentioned loads can be a timing controller, a source driver or a gate driver, and these loads can be components of the display device.

For example, the power supply time sequence (or the power sequence) can be a sequence of providing the plurality of output voltages (or the driving voltages) generated by the power management chip 51 to the loads.

Figure 2A:
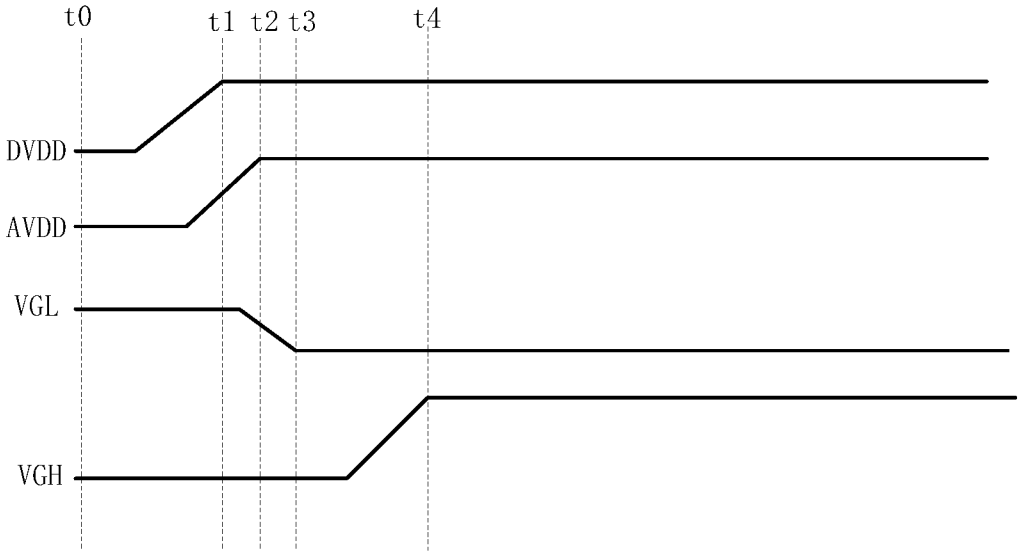
FIG. 2A is a power supply time sequence diagram provided by at least one embodiment of the present disclosure.

FIG. 2A illustrates a schematic diagram of a power supply time sequence of a display panel (or a display device). As illustrated in FIG. 2A, DVDD, AVDD, VGL, and VGH are provided to corresponding loads respectively at time point t1, at time point t2, at time point t3 and at time point t4, and t1<t2<t3<t4; in this case, the pre-determined power supply time sequence of the display panel (or the display device) is that DVDD, AVDD, VGL, and VGH are sequentially provided. For example, the power supply time sequence of the display panel (or the display device) as illustrated in FIG. 2A is a power supply time sequence that is needed by the display panel (or a correct power supply time sequence). It should be noted that, for convenience of description, t1, t2, t3 and t4 can not only respectively represent the time point t1, the time point t2, the time point t3 and the time point t4, but also respectively represent the time difference between the time point t1 and a time point t0, the time difference between the time point t2 and the time point t0, the time difference between the time point t3 and the time point t0, and the time difference between the time point t4 and the time point t0.

For example, in the display device, the load (for example, the above-mentioned source driver or gate driver) that is connected with the power supply time sequence control circuit 01 needs to receive DVDD before it can work. Therefore, DVDD is provided to the above-mentioned load before AVDD is provided to the above-mentioned load. For example, VGH and VGL are generated based on AVDD, and therefore, AVDD is to be provided before VGH and VGL (for example, AVDD needs to be provided to a corresponding load before VGH and VGL are provided to the corresponding load). For example, because the voltage of VGL is relatively low (for example, may be −8V) and the voltage of VGH is relatively high (for example, may be 30V), a voltage with a relatively small amplitude (for example, the above-mentioned VGL) can be provided to the above-mentioned driving circuit at the starting up time point, and then a voltage with a relatively large amplitude (for example, the above-mentioned VGH) can be provided to the above-mentioned driving circuit, so as to avoid providing a voltage with a relatively large amplitude to the driving circuit of the display device at the starting up time point, such that the occurrence of an overcurrent protection or an over temperature protection of the above-mentioned driving circuit can be avoided, or, the occurrence of an overcurrent protection or an over temperature protection of the power management chip (Power IC) that is configured to generate the above-mentioned power supply voltages can be avoided. Therefore, the power supply time point of VGL is before the power supply time point of VGH.

In an example, all the end points of the rising edges (or the falling edges) of DVDD, AVDD, VGH and VGL that are outputted by the power management chip 51 are assumed to be the time point t0 (t0 is assumed to be zero); in a case where the power supply voltages, DVDD, AVDD, VGH, VGL, that are outputted by the above-mentioned power management chip 51, are respectively inputted into the first input voltage terminals VIN1 connected with the delay control sub-circuits 10 in four different power supply time sequence control circuits (PSTS control circuits) 01, in order to obtain the power supply time sequence as illustrated in FIG. 2A, the delay time (for example, is equal to t1) of the delay control sub-circuit 10 in the power supply time sequence control circuit 01 that receives DVDD is greater than the delay time (for example, is equal to t2) of the delay control sub-circuit 10 in the power supply time sequence control circuit 01 that receives AVDD; the delay time (for example, is equal to t2) of the delay control sub-circuit 10 in the power supply time sequence control circuit 01 that receives AVDD is greater than the delay time (for example, is equal to t3) of the delay control sub-circuit 10 in the power supply time sequence control circuit 01 that receives VGL; the delay time (for example, is equal to t3) of the delay control sub-circuit 10 in the power supply time sequence control circuit 01 that receives VGL is greater than the delay time (for example, is equal to t4) of the delay control sub-circuit 10 in the power supply time sequence control circuit 01 at receives VGH.

Figure 2B:
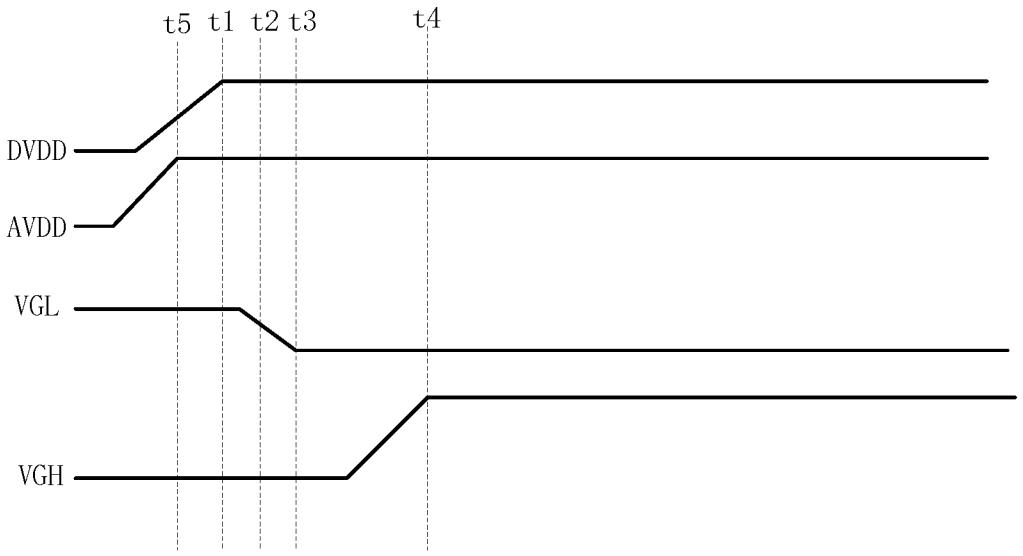
FIG. 2B is a time sequence diagram of a driving voltage outputted by a power management chip provided by at least one embodiment of the present disclosure.

FIG. 2B illustrates a time sequence diagram of the driving voltages (for example, DVDD, AVDD, VGH, VGL) outputted by a power management chip 51.

In another example, DVDD, AVDD, VGH, VGL outputted by the power management chip 51 are assumed as illustrated in FIG. 2B, that is, the power supply time sequences of DVDD, VGH and VGL satisfy the requirement, but the power supply time point of the VDD is ahead of the pre-determined power supply time point thereof for t2-t5. In this case, t2-t5 needs to be additionally added in the delay time of the delay control sub-circuit 10 in the power supply time sequence control circuit 01 that receives AVDD as compared with the delay time of the delay control sub-circuit 10 in the power supply time sequence control circuit 01 that receives DVDD (or VGH, VGL).

In the following, the power supply time sequence control circuit 01 provided by at least one embodiment of the present disclosure is exemplarily described with reference to FIG. 3A-FIG. 3C.

Figure 3A:
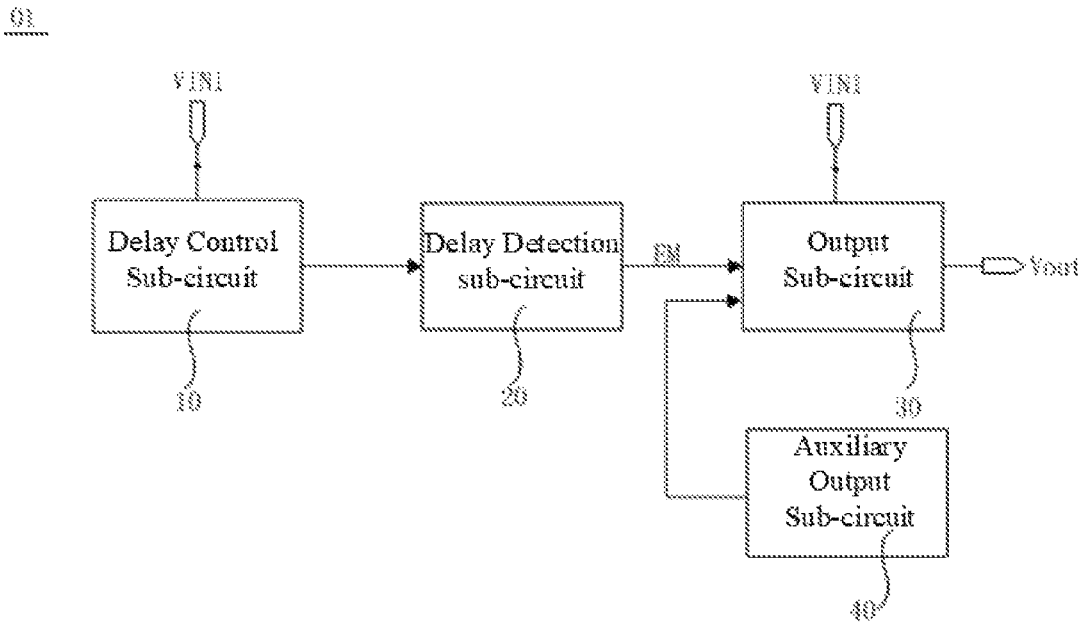
FIG. 3A is another exemplary block diagram of a power supply time sequence control circuit provided by at least one embodiment of the present disclosure.

FIG. 3A is another exemplary block diagram of a power supply time sequence control circuit 01 provided by at least one embodiment of the present disclosure.

For example, in the power supply time sequence control circuit 01 provided by some embodiment of the present disclosure, the output time point of the first voltage V1 outputted by the first input voltage terminal VIN1 can be delayed as needed via the delay control sub-circuit 10. For example, the power supply time sequence control circuit 01 can control the output time point of the first voltage V1 via pure hardware, and therefore, the output time point of the first voltage V1 can be more accurately controlled by the power supply time sequence control circuit 01 as compared with the method of controlling the output time point of the first voltage V1 by codes. Therefore, in a case where the power supply time sequence control circuit 01 is (or, a plurality of power supply time sequence control circuits 01 are) used to control the power sequence of the display panel, the power supply time sequence control circuit 01 can control the power sequence of the display panel more accurately as compared with the method of controlling the power sequence of the display panel by software codes, and thus, potential display defects caused by abnormality of the power sequence of the display panel can be avoided.

As illustrated in FIG. 3A, the delay detection sub-circuit 20 is electrically connected with the above-mentioned delay control sub-circuit 10 (for example, the output terminal of the delay control sub-circuit 10) and the output sub-circuit 30 (for example, the input terminal of the output sub-circuit 30). The delay detection sub-circuit 20 is configured to send a trigger signal Em to the output sub-circuit 30 in a case where a voltage having a value substantially equal to the value of the first voltage V1 is received by the delay detection sub-circuit 20 (for example, after delaying for the pre-determined time period T, that is, at time point T0+T).

For example, as illustrated in FIG. 3A, the above-mentioned output sub-circuit 30 is also electrically connected with the above-mentioned first input voltage terminal VIN1 and signal output terminal Vout (for example, the signal output terminal Vout of the power supply time sequence control circuit 01). The output sub-circuit 30 is configured to be in an on-state in response to the trigger signal Em outputted by the delay detection sub-circuit 20, and to output the first voltage V1 at the first input voltage terminal VIN1 to the signal output terminal Vout.

As illustrated in FIG. 3A, in some examples, the power supply time sequence control circuit 01 can further include an auxiliary output sub-circuit 40.

Figure 3B:
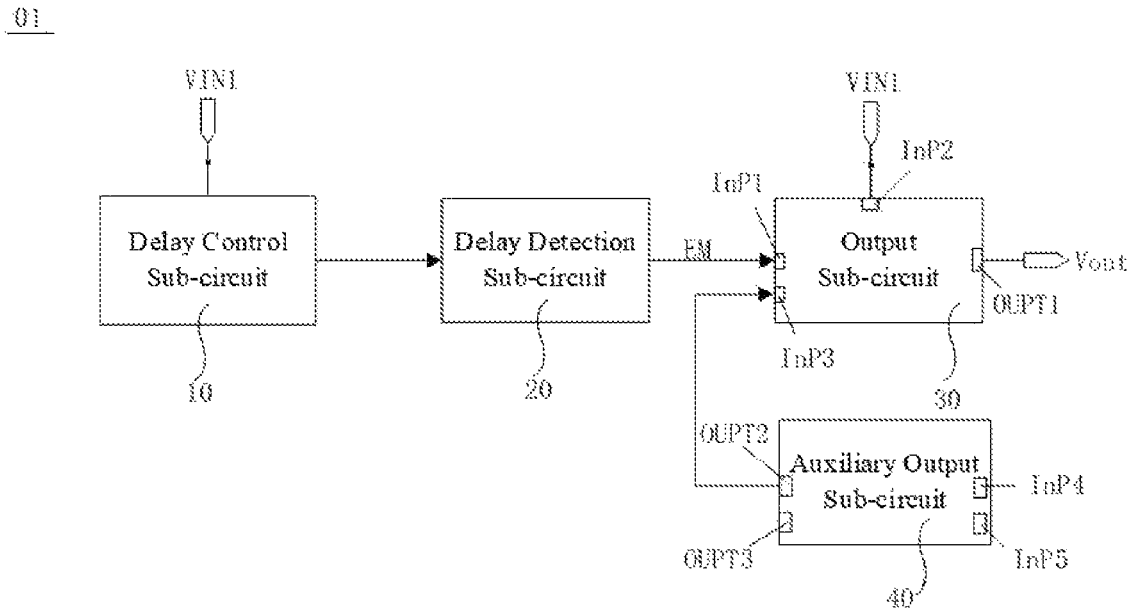
FIG. 3B is further another exemplary block diagram of a power supply time sequence control circuit provided by at least one embodiment of the present disclosure.

FIG. 3B is further another exemplary block diagram of a power supply time sequence control circuit 01 provided by at least one embodiment of the present disclosure. As compared with the power supply time sequence control circuit 01 illustrated in FIG. 3A, the power supply time sequence control circuit 01 illustrated in FIG. 3B further illustrates the input terminals and the output terminal of the output sub-circuit 30 and the input terminals and the output terminals of the auxiliary output sub-circuit 40.

For example, as illustrated in FIG. 3B, the output sub-circuit 30 includes a first signal input terminal InP1, a second signal input terminal InP2, a third signal input terminal InP3 and a signal output terminal OUPT1; the first signal input terminal InP1 of the output sub-circuit 30 is configured to be connected with the output terminal of the delay detection sub-circuit 20, so as to receive the trigger signal Em; the second signal input terminal InP2 of the output sub-circuit 30 is configured to receive the first voltage V1 or is configured to receive the second voltage V2 (not shown in FIG. 3B, referring to FIG. 8); the third signal input terminal InP3 of the output sub-circuit 30 is configured to receive the first reference voltage (not shown in FIG. 3B, referring to FIG. 6) or is configured to receive the second reference voltage.

Figure 8:
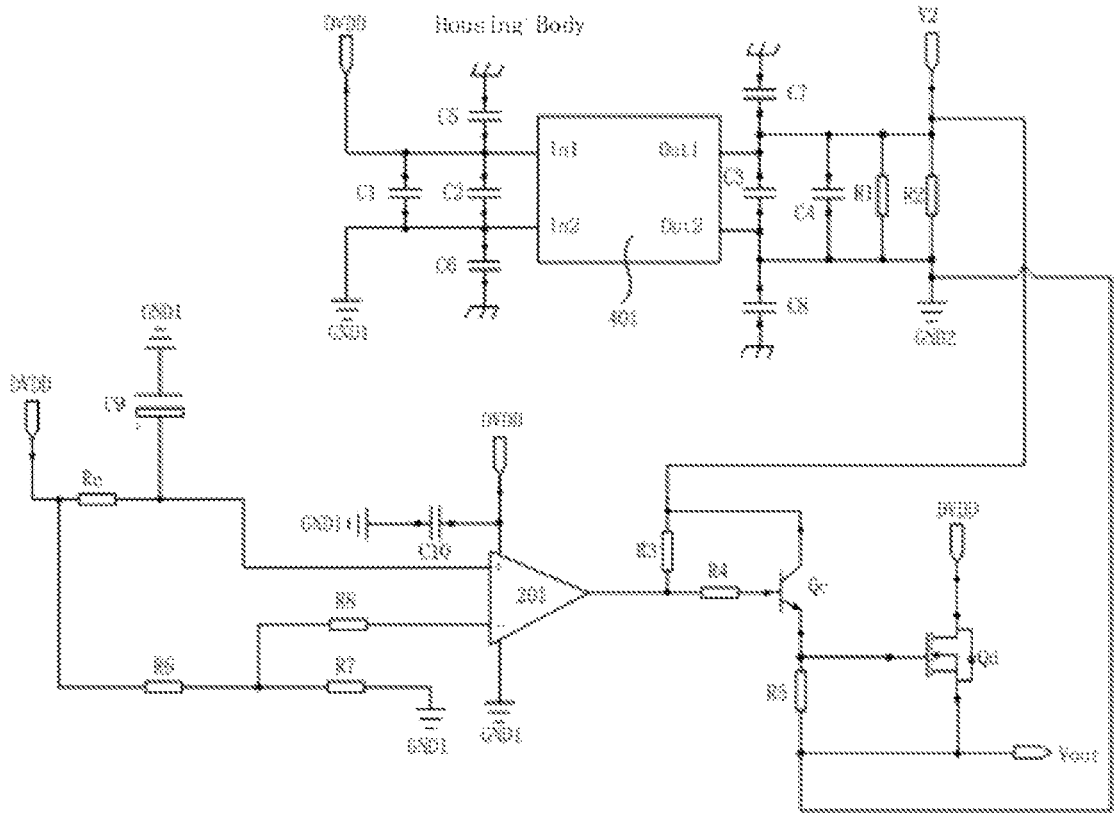
FIG. 8 is a schematic structural diagram of further another power supply time sequence control circuit provided by at least one embodiment of the present disclosure.

As illustrated in FIG. 3B, the auxiliary output sub-circuit 40 includes a first input terminal InP4, a second input terminal InP5, a first output terminal OUPT2 and a second output terminal OUPT3. For example, as illustrated in FIG. 3B and FIG. 8, the first input terminal InP4 of the auxiliary output sub-circuit 40 and the second input terminal InP5 of the auxiliary output sub-circuit 40 are electrically connected with the first input voltage terminal VIN1 and a first reference voltage terminal Vref1, respectively. The auxiliary output sub-circuit 40 is configured to generate the second voltage V2 and the second reference voltage (for example, GND2) based on the first voltage V1 (for example, DVDD) provided by the first input voltage terminal VIN1 and the first reference voltage (for example, GND1) provided by the first reference voltage terminal Vref1. For example, the second voltage V2 and the second reference voltage (for example, GND2) are outputted via the second output terminal OUPT3 of the auxiliary output sub-circuit 40 and the first output terminal OUPT2 of the auxiliary output sub-circuit 40, respectively.

Figure 3C:
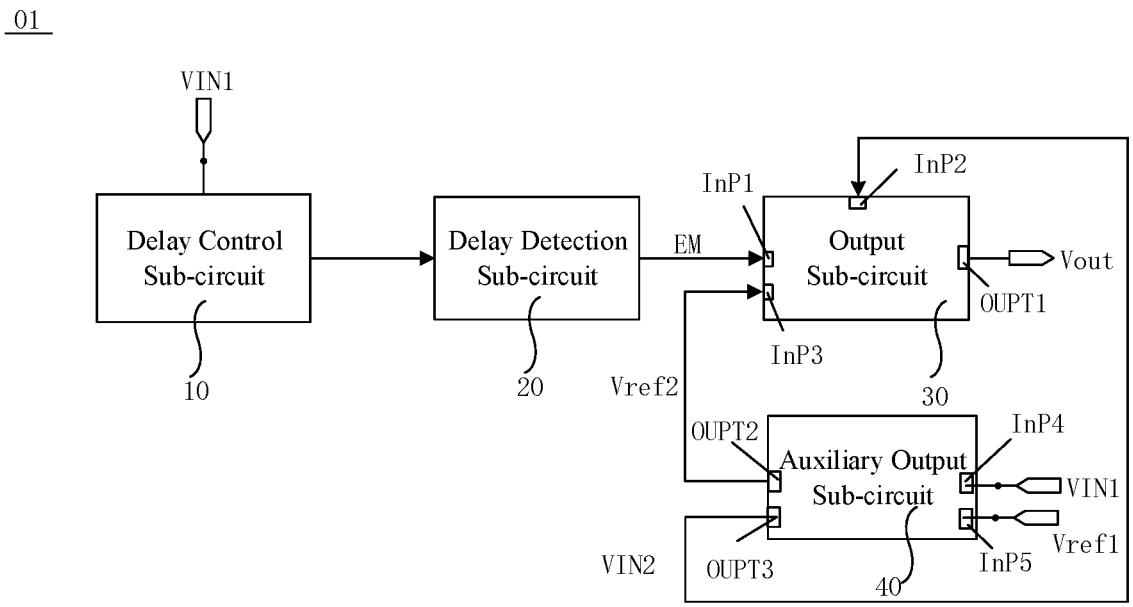
FIG. 3C is further another exemplary block diagram of a power supply time sequence control circuit provided by at least one embodiment of the present disclosure.

FIG. 3C is further another exemplary block diagram of a power supply time sequence control circuit 01 provided by at least one embodiment of the present disclosure. As compared with the power supply time sequence control circuit 01 illustrated in FIG. 3B, the power supply time sequence control circuit 01 illustrated in FIG. 3C further illustrates the connection relationships among the auxiliary output sub-circuit 40 and the output sub-circuit 30, the first input voltage terminal VIN1 and the first reference voltage terminal Vref1.

For example, as illustrated in FIG. 3C, in a case where the third signal input terminal InP3 of the output sub-circuit 30 is configured to receive the second reference voltage, the first output terminal OUPT2 of the auxiliary output sub-circuit 40 is connected with the third signal input terminal InP3 of the output sub-circuit 30. For example, as illustrated in FIG. 3C, in a case where the second signal input terminal InP2 of the output sub-circuit 30 is configured to receive the second voltage V2, the second output terminal OUPT3 of the auxiliary output sub-circuit 40 is connected with the second signal input terminal InP2 of the output sub-circuit 30. For example, as illustrated in FIG. 3C, the power supply time sequence control circuit 01 can allow the output sub-circuit 30 to be able to continuously output the first voltage provided by the first input voltage terminal VIN1 via the signal output terminal Vout of the power supply time sequence control circuit 01.

Illustrative descriptions are given to the power supply time sequence control circuit 01 provided by at least one embodiment of the present disclosure with reference to the circuit structures as illustrated in FIG. 4-FIG. 8 in the following.

Figure 6:
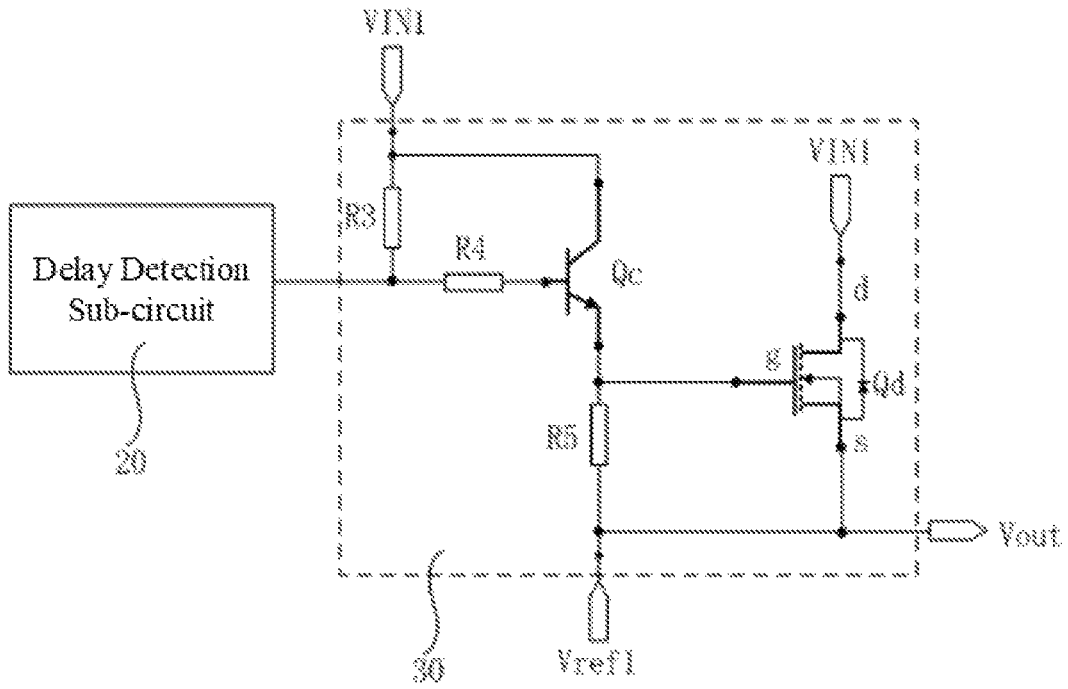
FIG. 6 is another structural diagram of the output sub-circuit as illustrated in FIG. 3A.

For example, FIG. 6 illustrates an example of the circuit structure of an output sub-circuit 30 provided by at least one embodiment of the present disclosure, and for convenience of description, FIG. 6 further illustrates a delay detection sub-circuit 20. For example, the output sub-circuit 3 as illustrated in FIG. 6 may cause the signal output terminal Vout of the power supply time sequence control circuit 01 to be unable to output the first voltage V1 continuously, and concrete descriptions are given in the following with reference to FIG. 6.

For example, in order to allow the output sub-circuit 30 to be able to transmit the first voltage V1 at the first input voltage terminal VIN1 to the signal output terminal Vout, the above-mentioned output sub-circuit 30 can include a transistor that is electrically connected with the first input voltage terminal VIN1 and the signal output terminal Vout. For example, as illustrated in FIG. 6, the output sub-circuit 30 may include a driving transistor Qd, the first electrode (for example, the source electrode s or the drain electrode d) of the driving transistor Qd is electrically connected with the above-mentioned first input voltage terminal VIN1; the second electrode (for example, the drain electrode d or the source electrode s) of the driving transistor Qd is electrically connected with the above-mentioned signal output terminal Vout.

For example, the above-mentioned output sub-circuit 30 can further include a switching transistor Qc. The gate electrode of the switching transistor Qc is electrically connected with the delay detection sub-circuit 20 (the output terminal of the delay detection sub-circuit 20), so as to receive the trigger signal Em outputted by the delay detection sub-circuit 20; one electrode (for example, the second electrode) of the switching transistor Qc is electrically connected with the gate electrode of the above-mentioned driving transistor Qd; another electrode (for example, the first electrode) of the switching transistor Qc is electrically connected with the first input voltage terminal VIN1, so as to receive the first voltage V1 outputted by the first input voltage terminal VIN1. In this case, after the above-mentioned switching transistor Qc is turned on (for example, after the trigger signal Em or a valid electric level is received by the gate electrode of the switching transistor Qc), the voltage (that is, the first voltage V1 that is originated from the first input voltage terminal VIN1) inputted into the gate electrode of the driving transistor Qd through the switching transistor Qc that is turned on, can allow the driving transistor Qd to be turned on; after the driving transistor Qd is turned on, the driving transistor Qd can transmit the first voltage V1 provided by the first input voltage terminal VIN1 to the signal output terminal Vout.

In some embodiments, as illustrated in FIG. 6, the first electrode of the switching transistor Qc can be electrically connected with the first input voltage terminal VIN1, and the second electrode of the switching transistor Qc can be electrically connected with the gate electrode of the driving transistor Qd. Furthermore, the second electrode of the switching transistor Qc and the second electrode of the driving transistor Qd are further electrically connected with the first reference voltage terminal Vref1. In this case, after the switching transistor Qc is turned on, the voltage that is inputted into the gate electrode of the driving transistor Qd is the first voltage V1 at the first input voltage terminal VIN1, that is, the voltage Vg at the gate electrode of the driving transistor Qd is equal to V1; in this case, after the driving transistor Qd is turned on, the voltage Vd of the drain electrode, the voltage Vs of the source electrode and the voltage Vg of the gate electrode of the driving transistor Qd are all equal to the first voltage V1. In this case, the gate-source voltage of the driving transistor Qd is less than the threshold voltage of the driving transistor Qd ($Vgs=Vg-Vs=0<Vth$), and therefore, the driving transistor Qd no longer satisfies the turned-on condition $Vgs>Vth$, and in this case, the driving transistor Qd is turned-off, so as to cause that no signal is outputted from the signal output terminal Vout any more (that is, the signal output terminal Vout cannot continuously output the first voltage V1), such that an output discontinuity problem can occur in the entire power supply time sequence control circuit 01. In this case, the signal output terminal Vout is unable to keep on providing (or continuously provide) the power supply voltage to the load connected with the signal output terminal Vout.

For example, by providing the auxiliary output sub-circuit 40, the output sub-circuit 30 can be enabled to allow the signal output terminal Vout of the power supply time sequence control circuit 01 to continuously output the first voltage V1, and concrete descriptions are given in the following with reference to FIG. 3A-FIG. 3C, FIG. 4-FIG. 5, FIG. 7 and FIG. 8.

For example, as illustrated in FIG. 3A-FIG. 3C, the power supply time sequence control circuit 01 further includes the auxiliary output sub-circuit 40. The auxiliary output sub-circuit 40 is electrically connected with the above-mentioned output sub-circuit 30. The auxiliary output sub-circuit 40 can be configured to control the output sub-circuit 30, so as to keep the driving transistor Qd being in an on-state after the gate electrode of the switching transistor Qc receives the above-mentioned trigger signal EM.

For example, the auxiliary output sub-circuit 40 is configured to output the second voltage V2 and the second reference voltage based on the first voltage V1 and the first reference voltage. For example, the first voltage V1 (the first reference voltage) and the second voltage V2 (the second reference voltage) are isolated from each other. For example, the first voltage V1 is different from the second voltage V2, the first reference voltage is different from the second reference voltage, and the voltage difference between the first voltage V1 and the first reference voltage, for example, may be equal to the voltage difference between the second voltage V2 and the second reference voltage. For example, V2 is greater than V1.

In the following, specific structures of the auxiliary output sub-circuit 40 and the above-mentioned output sub-circuit 30 that is electrically connected with the auxiliary output sub-circuit 40 are described in detail.

Figure 4:
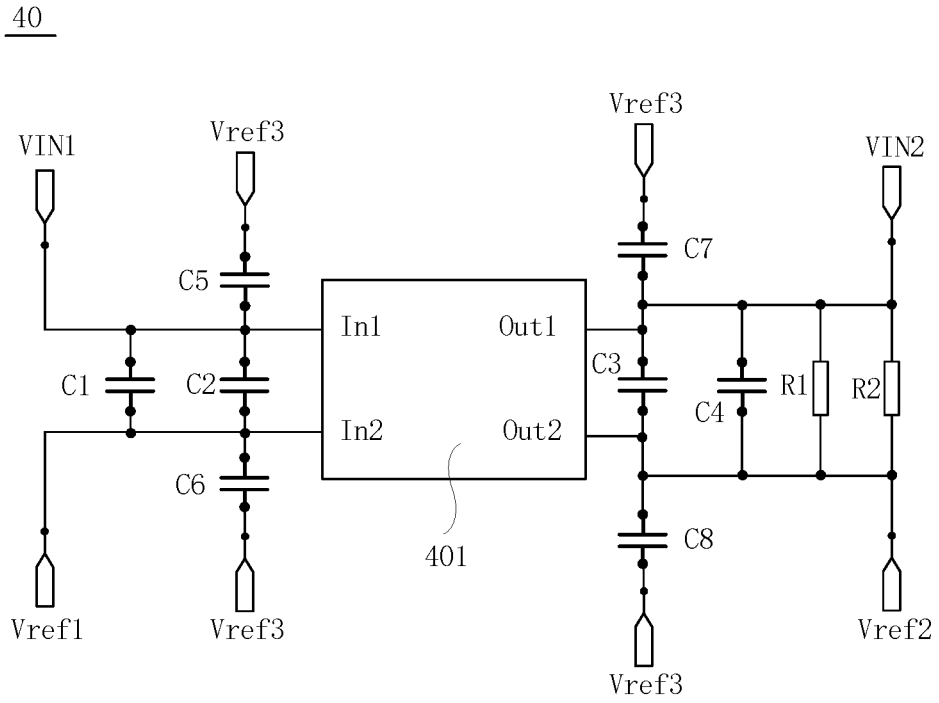
FIG. 4 is a schematic structural diagram of the auxiliary output sub-circuit as illustrated in FIG. 3A.

As illustrated in FIG. 4, the above-mentioned auxiliary output sub-circuit 40 is further electrically connected with the first input voltage terminal VIN1, the first reference voltage terminal Vref1, the second input voltage terminal VIN2, the second reference voltage terminal Vref2, and a third reference voltage terminal Vref3. Furthermore, the above-mentioned auxiliary output sub-circuit 40 further includes a power supply isolation module 401. For example, the power supply isolation module 401 can be implemented as a power supply isolator, and the power supply isolator can be realized by an electric circuit.

For example, the first input voltage terminal VIN1 and the first reference voltage terminal Vref1 are configured to be connected with the input terminals of the auxiliary output sub-circuit 40, the second input voltage terminal VIN2 and the second reference voltage terminal Vref2 are configured to be connected with the output terminals of the auxiliary output sub-circuit 40; the auxiliary output sub-circuit 40 is configured to output the second voltage V2 and the second reference voltage based on the first voltage V1 and the first reference voltage, and the second voltage V2 and the second reference voltage are configured to be respectively provided to the second input voltage terminal VIN2 and the second reference voltage terminal Vref2.

As illustrated in FIG. 4, the first input terminal In1 of the power supply isolation module 401 is electrically connected with the first input voltage terminal VIN1. The second input terminal In2 of the power supply isolation module 401 is electrically connected with the first reference voltage terminal Vref1 and the third reference voltage terminal Vref3. The first output terminal Out1 of the power supply isolation module 401 is electrically connected with the second input voltage terminal VIN2. The second output terminal Out2 of the power supply isolation module 401 is electrically connected with the second reference voltage terminal Vref2 and the third reference voltage terminal Vref3.

For example, the above-mentioned power supply isolation module 401 is configured to output the second voltage V2 that is isolated from the first voltage V1 to the second input voltage terminal VIN2 based on the first voltage V1 provided by the first input voltage terminal VIN1, the first reference voltage (for example, GND1) provided by the first reference voltage terminal Vref1, and the third reference voltage (for example, the voltage of a housing body) provided by the third reference voltage terminal Vref3. For example, the second input voltage terminal VIN2 is electrically connected with the first electrode of the switching transistor Qc of the output sub-circuit 30, and is configured to provide the second voltage V2 to the first electrode of the switching transistor Qc of the output sub-circuit 30.

It should be noted that, the above-mentioned power supply isolation module 401 can include a switching power supply topological structure (for example, a switching power supply topological electric circuit). In this case, under the action of the power supply isolation module 401, the voltage value of the first reference voltage GND1 inputted to the first reference voltage terminal Vref1 of the power supply isolation module 401 can be different from the voltage value of the second reference voltage GND2 outputted by the second reference voltage terminal Vref2 of the power supply isolation module 401.

In this case, the first voltage V1 inputted by the first input voltage terminal VIN1 being isolated from the second voltage V2 outputted by the second input voltage terminal VIN2 means that the reference point (the above-mentioned first reference voltage GND1) of the electric potential of the first input voltage terminal VIN1 is different from the reference point (the above-mentioned second reference voltage GND2) of the electric potential of the second input voltage terminal VIN2. In this case, the first voltage V1 inputted by the first input voltage terminal VIN and the second voltage V2 outputted by the second input voltage terminal VIN2 are not common-grounded, and therefore the first voltage V1 and the second voltage V2 do not interfere with each other.

On this basis, under the isolation function of the above-mentioned power supply isolation module 401, the voltage difference between the first voltage V1 and the first reference voltage GND1 can be equal to the voltage difference between the second voltage V2 and the second reference voltage GND2. Exemplarily, the first voltage V1=5V, and the first reference voltage GND1=0V; the second voltage V2=10V, and the second reference voltage GND2=5V. Thus, in a case where the power supply isolation module 401 is electrically connected with the output sub-circuit 30, the power supply isolation module 401 can provide an isolated voltage to the output sub-circuit 30, and has no effect (for example, adverse effect) on the output of the signal output terminal of the output sub-circuit 30 (or the signal output terminal Vout of the power supply time sequence control circuit 01). For example, the power supply isolation module 401 does not cause discontinuous output of the signal output terminal Vout. For example, the signal output terminal Vout can be allowed to continuously output the first voltage V1 by providing the power supply isolation module 401.

For example, as for the power supply time sequence control circuit 01 illustrated in FIG. 8, before the driving transistor Qd is turned on, the voltage Vg of the gate electrode, the voltage Vd of the drain electrode and the voltage Vs of the source electrode of the driving transistor Qd are respectively equal to the second voltage V2, the first voltage V1 (for example, DVDD) and the second reference voltage Vref2 (for example, a grounded voltage, that is, zero volt); in this case, the gate-source voltage Vgs of the driving transistor Qd is greater than the threshold voltage of the driving transistor Qd (for example, Vgs=Vg−Vs=V2>Vth), and therefore, the driving transistor Qd is turned on.

For example, as for the power supply time sequence control circuit 01 illustrated in FIG. 8, after the driving transistor Qd is turned on, the voltage Vg of the gate electrode, the voltage Vd of the drain electrode and the voltage Vs of the source electrode of the driving transistor Qd are respectively equal to the second voltage V2, the first voltage V1 (for example, DVDD) and the first voltage V1 (for example, DVDD); in this case, the gate-source voltage Vgs of the driving transistor Qd is greater than the threshold voltage of the driving transistor Qd (for example, Vgs=Vg−Vs=V2−V1>Vth), and therefore, the driving transistor Qd is still in an on-state. For example, because of the isolation function of the power supply isolation module 401, the second voltage V2 and the second reference voltage GND2 that are provided by the power supply isolation module 401 do not interfere the voltage value of the voltage Vd of the drain electrode of the driving transistor Qd (that is, the voltage outputted by the signal output terminal Vout), and therefore, the driving transistor Qd can be kept in an on-state, and the driving transistor Qd can continuously output the first voltage V1.

For example, the signal output terminal Vout of the power supply time sequence control circuit 01 is configured to receive the first voltage V1 outputted by the source electrode of the driving transistor Qd, and to use the first voltage V1 as an output of the power supply time sequence control circuit 01. For example, in a case where the power supply isolation module 401 is provided, because of the isolation function of the power supply isolation module 401, the signal output terminal Vout of the power supply time sequence control circuit 01 can continuously output the first voltage V1 provided by the driving transistor Qd that is turned on, without being affected by the second voltage V2 and the second reference voltage GND2 that are provided to the output sub-circuit 30 by the power supply isolation module 401.

On this basis, in order to increase the stability of the signal outputted by the auxiliary output sub-circuit 40, in some embodiments, as illustrated in FIG. 4, the above-mentioned output sub-circuit 40 can further include a first capacitor C1, a second capacitor C2, a third capacitor C3, and a fourth capacitor C4.

Among them, two terminals of the first capacitor C1 are electrically connected with the first input voltage terminal VIN1 and the first reference voltage terminal Vref1, respectively.

Two terminals of the second capacitor C2 are electrically connected with the first input terminal In1 of the power supply isolation module 401 and the second input terminal In2 of the power supply isolation module 401, respectively.

Two terminals of the third capacitor C3 are electrically connected with the first output terminal Out1 of the power supply isolation module 401 and the second output terminal Out2 of the power supply isolation module 401, respectively.

Two terminals of the fourth capacitor C4 are electrically connected with the second input voltage terminal VIN2 and the second reference voltage terminal Vref2, respectively.

As can be seen from the above descriptions, two terminals of any capacitor of the above-mentioned first capacitor C1, second capacitor C2, third capacitor C3, fourth capacitor C4 are connected with a positive voltage terminal and a negative voltage terminal, respectively, and therefore, the above-mentioned capacitors are all X capacitors, and configured for eliminating differential mode interference and radiation.

Furthermore, the above-mentioned auxiliary output sub-circuit 40 can further include a fifth capacitor C5, a sixth capacitor C6, a seventh capacitor C7, and an eighth capacitor C8.

Among them, two terminals of the fifth capacitor C5 are electrically connected with the first input terminal In1 of the power supply isolation module 401 and the third reference voltage terminal Vref3, respectively.

Two terminals of the sixth capacitor C6 are electrically connected with the second input terminal In2 of the power supply isolation module 401 and the third reference voltage terminal Vref3, respectively.

Two terminals of the seventh capacitor C7 are electrically connected with the first output terminal Out1 of the power supply isolation module 401 and the third reference voltage terminal Vref3, respectively.

Two terminals of the eighth capacitor C8 are electrically connected with the second output terminal Out2 of the power supply isolation module 401 and the third reference voltage terminal Vref3, respectively.

As can be seen from the above descriptions, two terminals of any capacitor of the above-mentioned fifth capacitor C5, sixth capacitor C6, seventh capacitor C7, eighth capacitor C8 are connected with a positive (or negative) voltage terminal and a grounded terminal (for example, GND1, GND2 or the housing body), and therefore the above-mentioned capacitors are Y capacitors, and configured for eliminating common mode interference.

Furthermore, the above-mentioned auxiliary output sub-circuit 40 can further include a first resistor R1 and a second resistor R2.

Between them, two terminals of the first resistor R1 are electrically connected with the second input voltage terminal VIN2 and the second reference voltage terminal Vref2, respectively.

Two terminals of the second resistor R2 are electrically connected with the second input voltage terminal VIN2 and the second reference voltage terminal Vref2, respectively.

The above-mentioned first resistor R1 and second resistor R2, are in parallel connection, and are configured for reducing the probability of generating fluctuations on the voltages outputted by the second input voltage terminal VIN2 and the second reference voltage terminal Vref2, so as to realize voltage stabilization.

Figure 5:
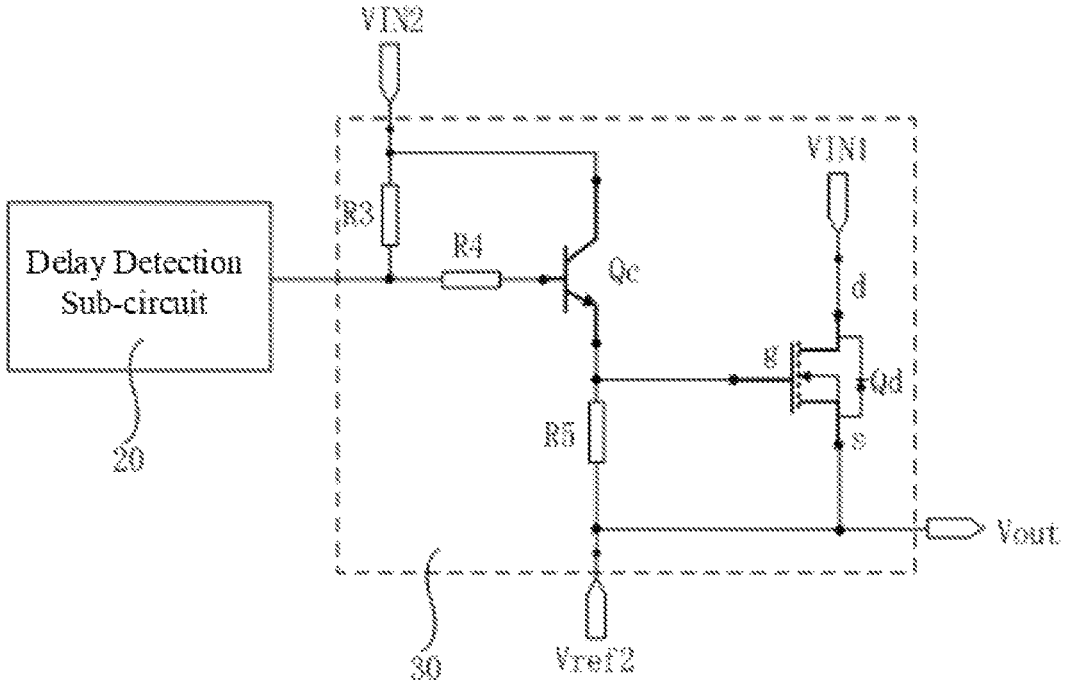
FIG. 5 is a schematic structural diagram of an output sub-circuit provided by at least one embodiment of the present disclosure.

For example, in a case where the auxiliary output sub-circuit 40 is electrically connected with the second input voltage terminal VIN2 and the second reference voltage terminal Vref2, in order to allow the above-mentioned auxiliary output sub-circuit 40 to be electrically connected with the output sub-circuit 30, in some other embodiments, as illustrated in FIG. 5, the first electrode of the switching transistor Qc of the above-mentioned output sub-circuit 30 is electrically connected with the second input voltage terminal VIN2, and the second electrode of the switching transistor Qc is electrically connected with the second reference voltage terminal Vref2.

The gate electrode of the driving transistor Qd of the above-mentioned output sub-circuit 30 is electrically connected with the second electrode of the switching transistor Qc, the first electrode of the driving transistor Qd is electrically connected with the first input voltage terminal VIN1, and the second electrode of the driving transistor Qd is electrically connected with the signal output terminal Vout and the second reference voltage terminal Vref2.

It should be noted that, the first electrode of any transistor of the above-mentioned switching transistor Qc and driving transistor Qd can be the source electrode, and the second electrode of any transistor of the above-mentioned switching transistor Qc and driving transistor Qd can be the drain electrode; alternatively, the first electrode is the drain electrode, and the second electrode is the source electrode. No limitation will be given in some embodiment of the present disclosure regarding the types of the above-mentioned transistors. Any transistor of the switching transistor Qc and the driving transistor Qd can be a triode, a TFT (Thin Film Transistor) or a MOS (Metal-Oxide-Semiconductor) transistor.

The above-mentioned driving transistor Qd is configured to be connected with a load (for example, the source driver or the gate driver of the display device), and therefore, the driving transistor Qd is required to have a certain load capacity (that is, the driving current outputted by the driving transistor Qd is required to be greater than a pre-determined current value). For example, when the above-mentioned power supply time sequence control circuit 01 is applied in the display device, the load capacity (that is, the driving current outputted by the driving transistor Qd) is greater than 60 A. Because MOS transistors can realize a large load capacity more easily, in some embodiments of the present disclosure, the above-mentioned driving transistor Qd can be a MOS transistor.

The accompany drawings provided by some embodiments of the present disclosure takes that the switching transistor Qc is a triode and the driving transistor Qd is a MOS transistor as an example, and descriptions are given to embodiments of the present disclosure based on the above mentioned example, but embodiments of the present disclosure are not limited to this case.

For example, in order to increase the stability of the voltage outputted to the second electrode of the driving transistor Qd, the above-mentioned output sub-circuit 30 can further include: a third resistor R3, a fourth resistor R4 and a fifth resistor R5.

As illustrated in FIG. 4 and FIG. 6, two terminals of the third resistor R3 are electrically connected with the second input voltage terminal VIN2 and the delay detection sub-circuit 20, respectively. Two terminals of the fourth resistor R4 are electrically connected with the delay detection sub-circuit 20 and the gate electrode of the switching transistor Qc, respectively. Two terminals of the fifth resistor R5 are electrically connected with the second electrode of the switching transistor Qc and the second reference voltage terminal Vref2, respectively.

As can be seen from the above descriptions, both of the auxiliary output sub-circuit 40 illustrated in FIG. 4 and the output sub-circuit 30 illustrated in FIG. 5 are connected with the second input voltage terminal VIN2 and the second reference voltage terminal Vref2. Therefore, the electrical connection between the auxiliary output sub-circuit 40 and the output sub-circuit 30 can be realized via the above-mentioned second input voltage terminal VIN2 and second reference voltage terminal Vref2, such that the output sub-circuit 30 can receive the isolated first voltage V1 and second reference voltage Vref2 that are outputted by the auxiliary output sub-circuit 40.

In this case, in order to solve the problem that the above-mentioned driving transistor Qd cannot be kept in an on-state after being turned on, in some embodiment of the present disclosure, the output sub-circuit 40 is electrically connected with the output sub-circuit 30 via the second input voltage terminal VIN2 and the second reference voltage terminal Vref2, and the second voltage V2 that is outputted by the auxiliary output sub-circuit 40 through the second input voltage terminal VIN2 and isolated from the first voltage V1 can be provided to the first electrode of the switching transistor Qc as illustrated in FIG. 5.

In this case, after the above-mentioned switching transistor Qc is controlled to be turned on by the voltage outputted by the delay detection sub-circuit 20, the second voltage V2 outputted by the second input voltage terminal VIN2 can be transmitted to the gate electrode of the driving transistor Qd via the switching transistor Qc, and in this case, the driving transistor Qd is turned on, the first voltage V1 outputted by the first input voltage terminal VIN1 can be transmitted to the signal output terminal Vout via the driving transistor Qd.

For example, after the driving transistor Qd is turned on, the voltage Vd of the drain electrode of the driving transistor Qd is equal to the voltage Vs of the source electrode of the driving transistor Qd, that is, Vd=Vs=V1. In this case, the voltage Vg of the gate electrode of the driving transistor Qd is equal to V2. Because of the isolation function of the power supply isolation module 401 in the above-mentioned auxiliary output sub-circuit 40, the first voltage V1 and the second voltage V2 are isolated from each other, the gate-source voltage Vgs of the driving transistor Qd cannot be obtained through calculation based on the first voltage V1 and the second voltage V2, and therefore, after the driving transistor Qd is turned on, the value of the voltage Vs of the source electrode of the driving transistor Qd cannot affect the state (on-state or off-state) of the driving transistor Qd (for example, cannot cause the state of the driving transistor Qd to be changed from an on-state into an off-state), such that the driving transistor Qd can be kept in an on-state.

The circuit structure of the remaining sub-circuits (that is, the delay control sub-circuit 10 and the delay detection sub-circuit 20) as illustrated in FIG. 1 will be described in detail in the following with reference to FIG. 7.

Figure 7:
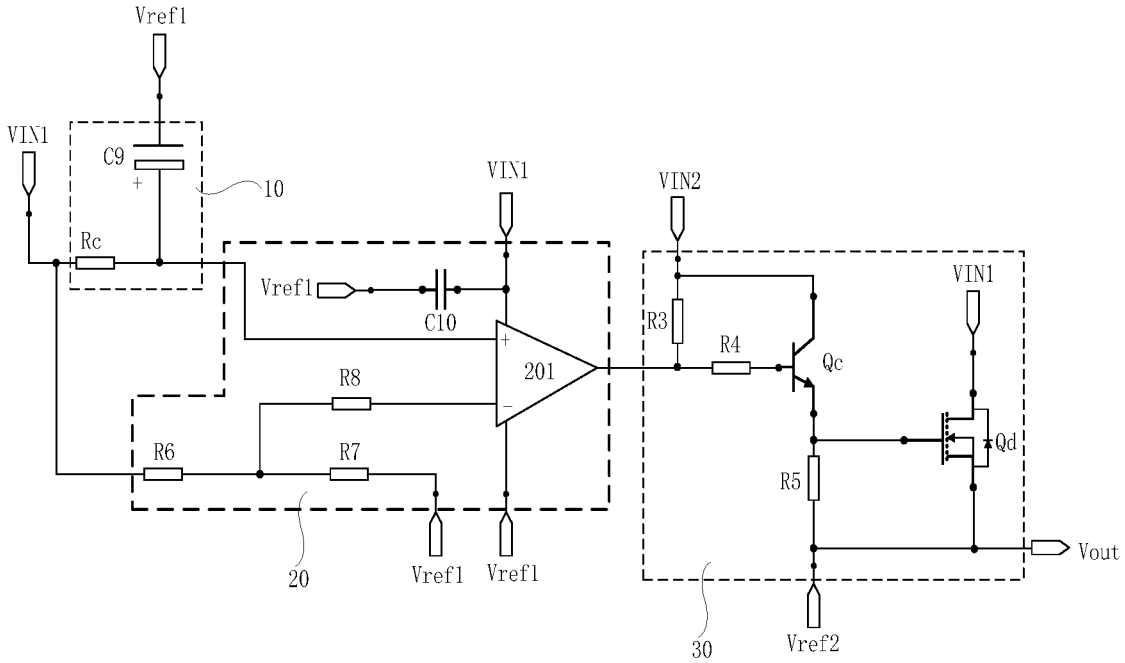
FIG. 7 is a schematic structural diagram of another power supply time sequence control circuit provided by at least one embodiment of the present disclosure.

As illustrated in FIG. 7, the above-mentioned delay control sub-circuit 10 is electrically connected with the first reference voltage terminal Vref1, and the delay control sub-circuit 10 includes an adjustable resistor Rc and a ninth capacitor C9.

One terminal (that is, the first terminal) of the above-mentioned adjustable resistor Rc is electrically connected with the first input voltage terminal VIN1, the other terminal (that is, the second terminal) of the adjustable resistor Rc is electrically connected with one terminal (that is, the first terminal) of the ninth capacitor C9. The first terminal of the ninth capacitor C9 is configured as the output terminal of the delay control sub-circuit 10.

Furthermore, the other terminal (that is, the second terminal) of the ninth capacitor C9 is electrically connected with the first reference voltage terminal Vref1. Here, the ninth capacitor C9 can be an ordinary capacitor, or can be an electrolytic capacitor, and no specific limitation will be given in embodiments of the present disclosure in this respect.

In this case, the resistance value R of the adjustable resistor Rc can be adjusted, so as to allow that the time Tc (that is, the charging time of the ninth capacitor C9) for increasing (increasing by charging) the capacitor voltage Vc9 of the ninth capacitor C9 to the first voltage V1 is equal to the pre-determined time period T, such that the delay control sub-circuit 10 can output the above-mentioned first voltage V1 after delaying for the pre-determined time period T.

The charging time of the ninth capacitor C9 satisfies the following expression: $Tc=T=\alpha\times R\times C$. Here, $\alpha$ is a constant relevant with the rising time of the capacitor voltage; R is the resistance value of the adjustable resistor Rc; C is the capacitance value of the ninth capacitor C9. As can be seen from the above-mentioned expression, the greater the resistance value R of the adjustable resistor Rc, the longer the charging time of the ninth capacitor C9, and thus, the longer the pre-determined time period T; the smaller the resistance value R of the adjustable resistor Rc, the shorter the charging time of the ninth capacitor C9, and thus, the shorter the pre-determined time period T.

For example, in a case where the power supply time sequence control circuit 01 provided by some embodiment of the present disclosure is applied in the display device, the resistance adjustment range of the adjustable resistor Rc can be set based on the first voltage V1 provided by the above-mentioned first input voltage terminal VIN1. For example, the resistance adjustment range of the above-mentioned adjustable resistor Rc can be 1 kΩ~10 MΩ. In a case where the resistance value of the adjustable resistor Rc is less than 1 kΩ, even though the adjustment accuracy of the pre-determined time period T is relatively high, the adjustment range of the pre-determined time period T is relatively small, such that the difficulty of adjusting the power supply time sequence (the power sequence of the display panel) is increased. Furthermore, in a case where the adjustment value of the adjustable resistor Rc is greater than 10 MΩ, the pre-determined time period T and the charging time Tc of the ninth capacitor C9 can be beyond the upper limit of the power-on time during the start-up period, such that start-up delay can be caused.

For example, as illustrated in FIG. 7, the above-mentioned delay detection sub-circuit 20 is further electrically connected with the first reference voltage terminal Vref1. For example, the first reference voltage terminal Vref1 is grounded.

As illustrated in FIG. 7, the delay detection sub-circuit includes a comparator 201, a sixth resistor R6, a seventh resistor R7, an eighth resistor R8 and a tenth capacitor C10.

The first input terminal (the positive input terminal) of the comparator 201 is electrically connected with the delay control sub-circuit 10, and the second input terminal (the negative input terminal) of the comparator 201 is electrically connected with one terminal (the first terminal) of the eighth resistor R8.

As illustrated in FIG. 7, the positive input terminal of the above-mentioned comparator 201 is connected with the first terminal of the ninth capacitor C9 in the delay control sub-circuit 10 (that is, the output terminal of the delay control sub-circuit 10). Furthermore, in order to allow the comparator 201 to work with better effect, the comparator 201 can be further connected with a positive operating voltage (for example, the first voltage V1 provided by the first input voltage terminal VIN1) and a negative operating voltage (for example, the first reference voltage GND1 of the first reference voltage terminal Vref1). No limitation will be given in embodiments of the present disclosure regarding the values of the positive operating voltage and the negative operating voltage, as long as the comparator 201 can be driven to work. For example, the positive operating voltage is greater than zero volt, and the negative operating voltage is less than or equal to zero volt.

As illustrated in FIG. 7, the output terminal of the comparator 201 is electrically connected with the output sub-circuit 30. In a case where the structure of the output sub-circuit 30 is the structure as described above, the output terminal of the above-mentioned comparator 201 is electrically connected with the gate electrode of the switching transistor Qc in the output sub-circuit 30. For example, the output terminal of the comparator 201 is electrically connected with the gate electrode of the switching transistor Qc in the output sub-circuit 30 via the fourth resistor R4.

As illustrated in FIG. 7, the other terminal (the second terminal) of the eighth resistor R8 is electrically connected with one terminal (the first terminal) of the sixth resistor R6 and one terminal (the first terminal) of the seventh resistor R7. The other terminal (the second terminal) of the sixth resistor R6 is electrically connected with the first input voltage terminal VIN1. The other terminal (the second terminal) of the seventh resistor R7 is electrically connected with the first reference voltage terminal Vref1.

In this case, the value of the voltage V− received by the negative voltage terminal of the comparator 201 can be adjusted by setting the resistance values of the above-mentioned resistor R6 and resistor R7, such that, for example, the value of the first voltage V1 and the pre-determined time period T can be controlled. For example, in a case where the voltage V+ received by the positive voltage terminal of the comparator 201 is greater than V−, a first electric level (for example, a high electric level or a valid electric level, the voltage value of the first electric level is, for example, greater than zero volts) is outputted by the output terminal of the comparator 201 to the gate electrode of the switching transistor Qc, so as to turn on the switching transistor Qc.

In a case where the capacitor voltage Vc9 of the ninth capacitor C9 has not been increased to the first voltage V1 provided by the first input voltage terminal VIN1, the voltage value V+ of the positive voltage terminal of the comparator 201 is less than the voltage value V−, in this case, the output terminal of the comparator 201 outputs a second electric level (for example, a low electric level or an invalid electric level, the voltage value of the second electric level is, for example, smaller than zero volts), so as to allow the above-mentioned switching transistor Qc to be turned off. For example, the valid electric level is an electric level that allows the transistor to be turned on, and the invalid electric level is an electric level that allows the transistor to be turned off.

It should be noted that, during setting the value of the voltage V− received by the negative input terminal of the comparator 201, not only the value of the first voltage V1 provided by the first input voltage terminal VIN1 to the comparator 201 can be referred to, but also the type and sensitivity of the comparator 201 and the actual charging time of the ninth capacitor C9, etc., can be taken into consideration (to fine adjust the value of the voltage V−). In some embodiments, the voltage V− received by the negative input terminal of the above-mentioned comparator 201 can be slightly less than the first voltage V1. For example, the ratio of the difference between the first voltage V1 and the voltage V− to the first voltage V1 is about 5%, that is, (V1−V−)/V1 is about 5%.

For example, the above-mentioned fifth resistor R5 has a current limiting protection function. For example, two terminals of the tenth capacitor C10 are electrically connected with the first reference voltage terminal Vref1 and the positive input terminal of the comparator 201, respectively. For example, as illustrated in FIG. 7, the two terminals of the tenth capacitor C10 can also be electrically connected with the first reference voltage terminal Vref1 and the first input voltage terminal VIN1 (the first input voltage terminal VIN1 is electrically connected with a terminal of the comparator 201 that receives the first voltage V1), respectively. For example, the tenth capacitor C10 has the functions of voltage stabilization and rectification.

Hereinafter, taking that the first voltage V1 provided by the first input voltage terminal VIN1 is DVDD as an example, the control of the power supply time point of DVDD (the end point of the rising edge of the DVDD) is described by employing the power supply time sequence control circuit 01 provided by the embodiments of the present disclosure.

As illustrated in FIG. 8, firstly, the resistance value of the adjustable resistor Rc is adjusted to allow the time Tc for increasing (increasing by charging) the capacitor voltage Vc9 of the ninth capacitor C9 to the first voltage V1 to be equal to t1 (as illustrated in FIG. 2A), and the voltage DVDD charges the ninth capacitor C9 through the adjustable resistor Rc. During the initial stage of charging the ninth capacitor C9, the voltage V+ that is outputted by the ninth capacitor C9 to the positive input terminal of the comparator 201 is less than the voltage V− of the negative input terminal, in this case, the output terminal of the comparator 201 outputs a low electric level, the switching transistor Qc is turned off, the driving transistor Qd is turned off, and no signal is outputted by the signal output terminal Vout (or the signal output terminal Vout outputs a low electric level).

Then, after the charging time of the ninth capacitor C9 reaches t1 (greater than or equal to t1), the capacitor voltage Vc9 of the ninth capacitor C9 is equal to DVDD. In this case, the voltage V+ that is outputted to the positive input terminal of the comparator 201 by the ninth capacitor C9 is greater than the voltage V_ of the negative input terminal, the output terminal of the comparator 201 outputs a high electric level, and the switching transistor Qc is turned on.

Next, the power supply isolation module 401 of the auxiliary output sub-circuit 40 provides the isolated second voltage V2 and second reference voltage GND2 respectively to the first electrode and the second electrode of the switching transistor Qc. After the switching transistor Qc is turned on, the second voltage V2 is transmitted to the gate electrode of the driving transistor Qd; the gate electrode of the driving transistor Qd is controlled by the second voltage V2 to be kept in an on-state, and the driving transistor Qd transmits DVDD that is isolated from the second voltage V2 to the signal output terminal Vout, such that a delayed output of the voltage DVDD can be realized.

For example, the processes for controlling the power supply time points of the remaining voltages AVDD, VGL and VGH, are similar to or the same as the descriptions mentioned above, except that, as can be seen from the power supply time sequences of AVDD, VGL and VGH illustrated in FIG. 3A, the resistance value of the adjustable resistor Rc in the power supply time sequence control circuit 01 that receives AVDD is greater than the resistance value of the adjustable resistor Rc in the power supply time sequence control circuit 01 that receives DVDD, and is less than the resistance value of the adjustable resistor Rc in the power supply time sequence control circuit 01 that receives VGL. Furthermore, the resistance value of the adjustable resistor Rc in the power supply time sequence control circuit 01 that receives VGL is less than the resistance value of the adjustable resistor Rc in the power supply time sequence control circuit 01 that receives VGH. For example, the processes for controlling the remaining voltages, AVDD, VGL and VGH, are the same as or similar to the process for controlling the voltage DVDD, and no further descriptions will be given here.

Figure 9:
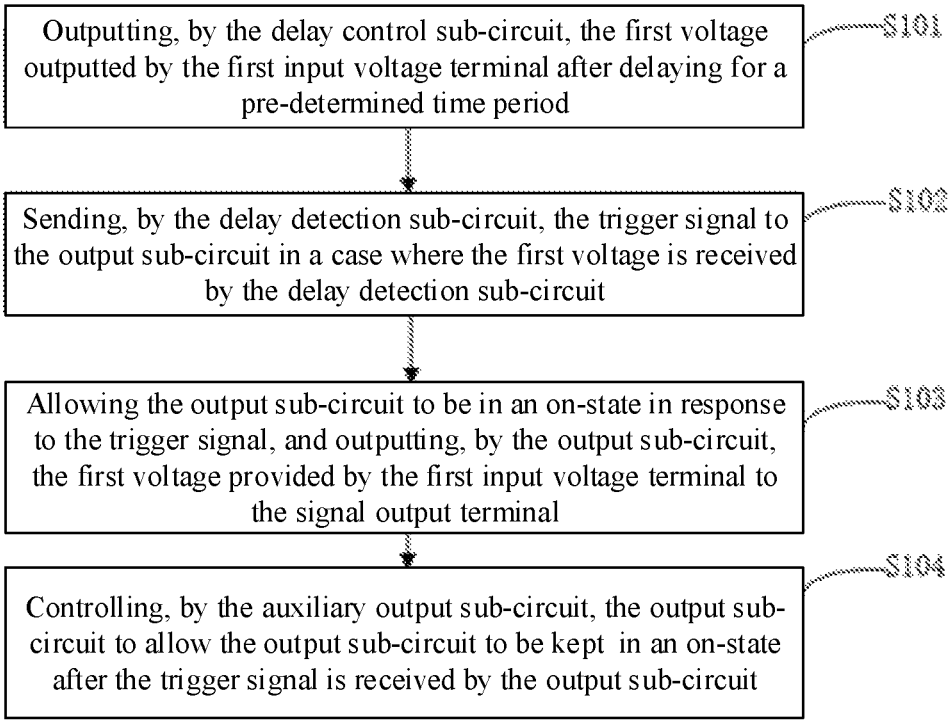
FIG. 9 is a flow chart of a control method of a power supply time sequence control circuit provided by at least one embodiment of the present disclosure.

Embodiments of the present disclosure provides a method for controlling any one of the above-mentioned power supply time sequence control circuits 01. As illustrated in FIG. 9, the above-mentioned method includes the following step S101-step S103.

Step S101: outputting, by the delay control sub-circuit 10, the first voltage V1 that is outputted by the first input voltage terminal VIN1 after delaying for a pre-determined time period T.

Step S102: after the pre-determined time period T, sending, by the delay detection sub-circuit 20, the trigger signal Em to the output sub-circuit 30 in a case where the delay detection sub-circuit 20 receives the first voltage V1.

Step S103: allowing the output sub-circuit 30 to be in an on-state in response to the above-mentioned trigger signal Em, and outputting, by the output sub-circuit 30, the first voltage V1 at the first input voltage terminal VIN1 to the signal output terminal Vout.

The control method of the above-mentioned power supply time sequence control circuit 01 has the same or similar technical effect as the power supply time sequence circuit 01 provided by the above-mentioned embodiments, and no further description will be given here.

Furthermore, in a case where the power supply time sequence control circuit further includes an auxiliary output sub-circuit, after the above-mentioned Step S103 is executed, the method further includes the following step S104.

Step S104: controlling, by the auxiliary output sub-circuit 40, the output sub-circuit 30 to allow the output sub-circuit 30 to be kept in an on-state after the trigger signal Em is received by the output sub-circuit 30.

Figure 11:
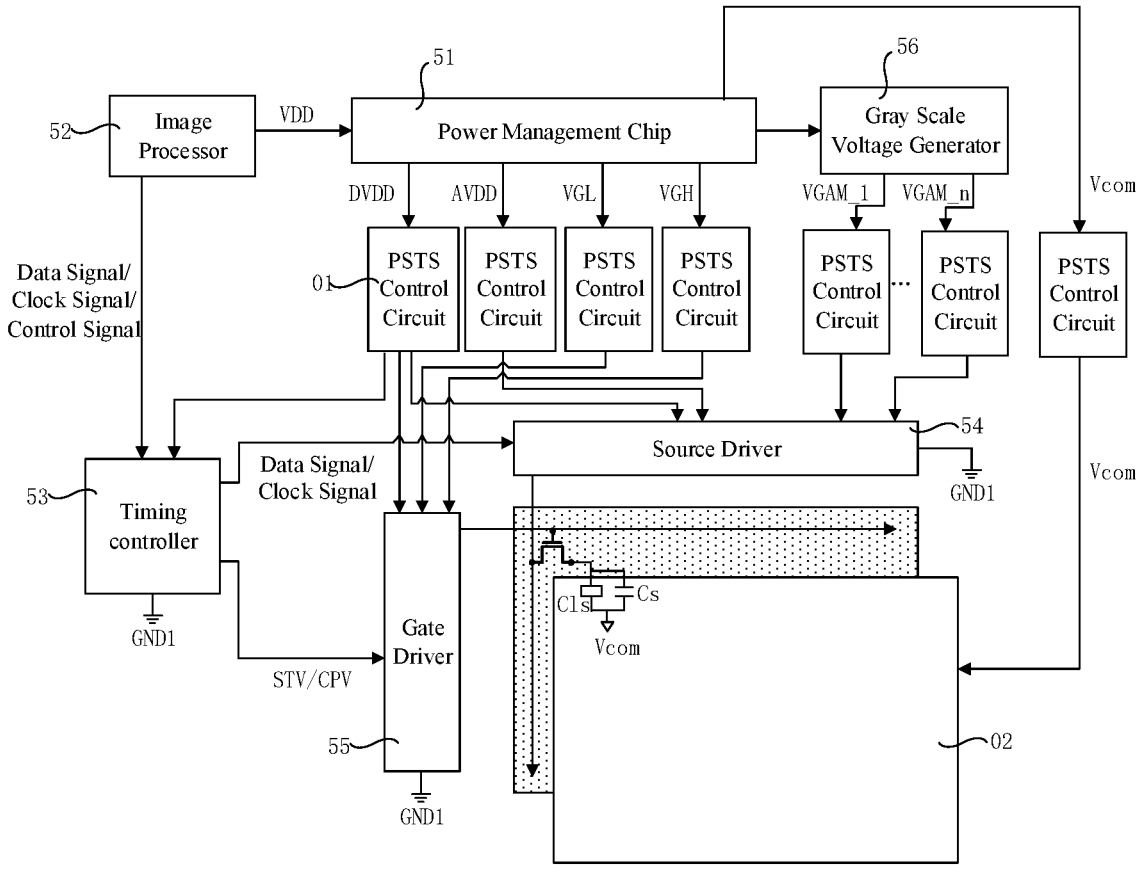
FIG. 11 is a schematic structural diagram of another display device provided by at least one embodiment of the present disclosure.
Figure 12:
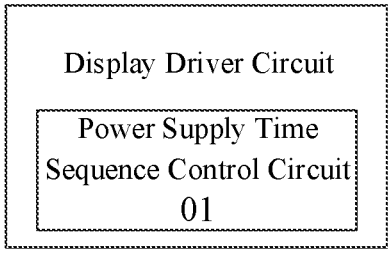
FIG. 12 is an exemplary block diagram of a display driver circuit provided by at least one embodiment of the present disclosure.

FIG. 12 is an exemplary block diagram of a display driver circuit provided by at least one embodiment of the present disclosure. The display driver circuit provided by the embodiments of the present disclosure are exemplarily described with reference to FIG. 10-FIG. 12. The display driver circuit provided by the embodiments of the present disclosure includes at least one of the above-mentioned power supply time sequence control circuits 01. The display driver circuit has the same or similar technical effect as the power supply time sequence control circuit 01 provided by the above-mentioned embodiments, and no further description will be given here.

The arrangement manner of the power supply time sequence control circuit 01 in the display driver circuit is described in the following with an example.

For example, the above-mentioned display driver circuit further includes a timing controller 53, a source driver 54 and a gate driver 55 as illustrated in FIG. 10 and FIG. 11.

The timing controller 53, the source driver 54 and the gate driver 55 can serve as the loads of the above-mentioned power supply time sequence control circuit 01.

Exemplarily, the signal output terminal Vout of the power supply time sequence control circuit 01 that is configured to output DVDD can be electrically connected with the timing controller 53.

For example, both the signal output terminals Vout, that are respectively configured for outputting DVDD and AVDD, of two power supply time sequence control circuits 01 can be electrically connected with the source driver 54.

For example, all the signal output terminals Vout, that are respectively configured for outputting DVDD, VGL and VGH, of three power supply time sequence control circuits 01 can be electrically connected with the gate driver 55.

For example, as illustrated in FIG. 10 and FIG. 11, in order to allow the above-mentioned loads to work with better effect, the above-mentioned timing controller 53, source driver 54 or gate driver 55 connected with the power supply time sequence control circuits 01 are further electrically connected with the first reference voltage terminal Vref1, so as to receive the first reference voltage GND1 outputted by the first reference voltage terminal Vref1.

Furthermore, the timing controller 53 is electrically connected with an image processor 52, the source driver 54 and the gate driver 55.

For example, the timing controller 53 is in an operating state after the timing controller 53 receives DVDD outputted by the power supply time sequence control circuit 01, and the timing controller 53 provides a data signal Dat and a clock signal (CLK) to the source driver 54 and provides a STV signal (a start vertical signal, which is also referred to as a frame start signal) and a CPV signal (a clock pulse vertical signal, which is also referred to as a scanning clock pulse signal), based on the data signal (Dat), the clock signal (CLK) and the control signal (ControlS) outputted by the image processor 52. For example, the timing controller 53 can further provide an output enable (OE) signal to the gate driver 55.

For example, the gate driver 55 can be in an operating state after receiving DVDD, VGH and VGL outputted by a plurality of power supply time sequence control circuits 01 and can perform progressive scanning with respect to the gate lines of the display panel.

For example, the source driver 54 can be in an operating state after receiving DVDD and AVDD outputted by the plurality of power supply time sequence control circuits 01 and can provide a data voltage Vdata to one row of sub-pixels, that are selected to be turned on, of the display panel through a data line.

For example, in order to realize gray scale display, as illustrated in FIG. 11, the display driver circuit further includes a gray scale voltage generator 56 that is electrically connected with the source driver 54. The gray scale voltage generator 56 is configured to generate a plurality of gray scale reference voltages (for example, VGAM_1, VGMA_2 . . . VGMA_n; n≥2, n is a positive integer). The source driver 54 can provide data voltages Vdata that are matched with pre-determined gray scale values to the sub-pixels of the display panel based on the above-mentioned gray scale reference voltages.

For example, one of reference gray scale output terminals of the gray scale voltage generator 56 is electrically connected with the first input voltage terminal VIN1 of one of the power supply time sequence control circuits.

For example, the signal output terminal Vout of the power supply time sequence control circuit 01 is electrically connected with the source driver 54. As mentioned above, the source driver 54 is further electrically connected with the first reference voltage terminal Vref1, so as to receive the first reference voltage GND1 outputted by the first reference voltage terminal Vref1.

In this way, the plurality of gray scale reference voltages generated by the gray scale voltage generator 56 are respectively controlled (respectively controlled through delaying) by the plurality of power supply time sequence control circuits 01, so as to allow the plurality of gray scale reference voltages to be able to be sequentially provided to the source driver 54 according to a pre-determined power supply sequence.

Embodiments of the present disclosure provides a display device, which includes any one of the above-mentioned display driver circuits.

For example, the above-mentioned display device further includes a display panel, as illustrated in FIG. 11, the display panel includes a common electrode layer 02.

In order to control the power supply time sequence of the common voltage Vcom inputted to the common electrode layer 02, one additional power supply time sequence control circuit 01 can be provided in the display device. The first input voltage terminal VIN of the power supply time sequence control circuit 01 is electrically connected with a voltage output terminal, that is configured to output the common voltage Vcom, of the above-mentioned power management chip 51, and the signal output terminal Vout of the power supply time sequence control circuit 01 is electrically connected with the above-mentioned common electrode layer 02, such that the time point that the common voltage Vcom is inputted to the common electrode layer 02 can be controlled by the power supply time sequence control circuit 01.

No limitation will be given in some embodiment of the present disclosure regarding the power supply time sequence of the common voltage Vcom. For example, the common voltage Vcom can be powered on after DVDD, AVDD, VGL and VGH are powered on, that is, the common voltage Vcom can be provided after DVDD, AVDD, VGL and VGH are provided.

For example, the plurality of driving voltages (for example, the power supply voltages), such as DVDD, AVDD, VGH, VGL and so on, can be respectively inputted into the first input voltage terminals VIN1 connected to the delay control sub-circuits 10 in different power supply time sequence control circuits 01. In this case, the delay time of the delay control sub-circuits 10 in the above-mentioned different power supply time sequence control circuits 01 can be set, so as to allow the plurality of power supply time sequence control circuits 01 to be able to sequentially output the plurality of driving voltages (for example, the power supply voltages) mentioned above according to pre-determined power supply time sequences.

On this basis, the delay detection sub-circuits 20 in different power supply time sequence control circuits 01 can judge the delay time of the delay control sub-circuit 10, and in a case where the delay time satisfies the requirement, for example, in a case the delay detection sub-circuit 20 in the power supply time sequence control circuit 01 that receives DVDD detects the actual delay time of the delay control sub-circuit 10, and the actual delay time is equal to (or is greater than or equal to) the above-mentioned time t1, the delay detection sub-circuit 20 controls the output sub-circuit 30 to allow the output sub-circuit 30 to be turned on, and in this case, the first voltage V1 at the first input voltage terminal VIN1 (for example, the above-mentioned DVDD) can be outputted, by the output sub-circuit 30, via the signal output terminal Vout of the power supply time sequence control circuit 01, to a load such as the source driver in the display device. The output manners of the remaining power supply voltages are the same as the descriptions mentioned above.

As can be seen from the above-mentioned descriptions, in the embodiments of the present disclosure, the power supply time sequences of the power supply voltages required by the loads can be controlled by the power supply time sequence control circuits 01 that serve as hardware equipment, and no codes is required for controlling the power supply time sequences. Therefore, the power supply time sequence control circuit 01 have relatively high stability and reliability, such that the deviation of the power supply time sequence caused by codes can be solved.

It should be noted that, in the embodiments of the present disclosure, the above-mentioned display device can be an LCD or OLED display device. And the display device can be any product or component that has a display function, such as a display, a TV, a digital photo frame, a mobile phone or a tablet computer. The display panel as illustrated in FIG. 10 and FIG. 11 are described by taking that the display panel is an LCD display panel as an example. In a case where the display panel is an OLED display panel, the arrangement manner of the above-mentioned display device having the power supply time sequence control circuit 01 is the same as or similar to the arrangement of the display device having the LCD display panel, and no further description will be given here.

It can be understood by those skilled in the art that, all of or part of the steps to realize the above-mentioned method embodiments can be accomplished by hardware related to program instructions, and the aforementioned program can be stored in a computer-readable storage medium, and in a case where the program is executed, the steps in the embodiments including the above-mentioned method are executed; the aforementioned storage media include: a ROM, a RAM, a disk or a CD-ROM and other media that can store program codes.

Although detailed description has been given above to the present disclosure with general description and specific implementations, it shall be apparent to those skilled in the art that some modifications or improvements can be made on the basis of the embodiments of the present disclosure. Therefore, all the modifications or improvements made without departing from the spirit of the present disclosure shall fall within the protection scope of the present disclosure.

What are described above is related to the illustrative embodiments of the disclosure only and not limitative to the protection scope of the disclosure; and the protection scope of the disclosure are defined by the accompanying claims.

What is claimed is:

1. A power supply time sequence control circuit, comprising: a delay control sub-circuit, a delay detection sub-circuit and an output sub-circuit, wherein the delay control sub-circuit is electrically connected with a first input voltage terminal, and the delay control sub-circuit is configured to receive a first voltage outputted by the first input voltage terminal, and to output the first voltage after delaying for a pre-determined time period;

the delay detection sub-circuit is electrically connected with the delay control sub-circuit and the output sub-circuit, and the delay detection sub-circuit is configured to send a trigger signal to the output sub-circuit upon the first voltage being received by the delay detection sub-circuit; and the output sub-circuit is electrically connected with the first input voltage terminal and a signal output terminal, and the output sub-circuit is configured to be in an on-state in response to the trigger signal, so as to output the first voltage provided by the first input voltage terminal to the signal output terminal, and to enable the signal output terminal to output the first voltage;

wherein the power supply time sequence control circuit further comprises an auxiliary output sub-circuit;

the auxiliary output sub-circuit is electrically connected with the output sub-circuit;

the auxiliary output sub-circuit is configured to allow the output sub-circuit to be kept in an on-state after the trigger signal is received by the output sub-circuit; and the output sub-circuit is configured to continuously output the first voltage to the signal output terminal after receiving the trigger signal, so as to enable the signal output terminal to continuously output the first voltage;

wherein the auxiliary output sub-circuit is further electrically connected with the first input voltage terminal, a first reference voltage terminal, a second input voltage terminal, a second reference voltage terminal and a third reference voltage terminal;

the auxiliary output sub-circuit comprises a power supply isolator, and the power supply isolator comprises a first input terminal, a second input terminal, a first output terminal and a second output terminal;

the first input terminal of the power supply isolator is electrically connected with the first input voltage terminal; the second input terminal of the power supply isolator is electrically connected with the first reference voltage terminal and the third reference voltage terminal; the first output terminal of the power supply isolator is electrically connected with the second input voltage terminal; the second output terminal of the power supply isolator is electrically connected with the second reference voltage terminal; and the power supply isolator is configured to, based on the first voltage provided by the first input voltage terminal, a first reference voltage provided by the first reference voltage terminal and a third reference voltage provided by the third reference voltage terminal, output a second voltage that is isolated from the first voltage to the second input voltage terminal, wherein the first reference voltage is different from a second reference voltage outputted by the second reference voltage terminal.

2. The power supply time sequence control circuit according to claim 1, wherein the power supply isolator is further configured to output the second reference voltage based on the first voltage, the first reference voltage and the third reference voltage, and the second reference voltage is isolated from the first reference voltage to the second reference voltage terminal.

3. The power supply time sequence control circuit according to claim 2, wherein the auxiliary output sub-circuit comprises a first capacitor, a second capacitor, a third capacitor, and a fourth capacitor;

two terminals of the first capacitor are electrically connected with the first input voltage terminal and the first reference voltage terminal, respectively;

two terminals of the second capacitor are electrically connected with the first input terminal of the power supply isolator and the second input terminal of the power supply isolator, respectively;

two terminals of the third capacitor are electrically connected with the first output terminal of the power supply isolator and the second output terminal of the power supply isolator, respectively; and two terminals of the fourth capacitor are electrically connected with the second input voltage terminal and the second reference voltage terminal, respectively.

4. The power supply time sequence control circuit according to claim 3, wherein the auxiliary output sub-circuit further comprises a fifth capacitor, a sixth capacitor, a seventh capacitor, and an eighth capacitor;

two terminals of the fifth capacitor are electrically connected with the first input terminal of the power supply isolator and the third reference voltage terminal, respectively;

two terminals of the sixth capacitor are electrically connected with the second input terminal of the power supply isolator and the third reference voltage terminal, respectively;

two terminals of the seventh capacitor are electrically connected with the first output terminal of the power supply isolator and the third reference voltage terminal, respectively; and two terminals of the eighth capacitor are electrically connected with the second output terminal of the power supply isolator and the third reference voltage terminal, respectively.

5. The power supply time sequence control circuit according to claim 4, wherein the auxiliary output sub-circuit further comprises a first resistor and a second resistor;

two terminals of the first resistor are electrically connected with the second input voltage terminal and the second reference voltage terminal, respectively; and the second resistor and the first resistor are in parallel connection, and two terminals of the second resistor are electrically connected with the second input voltage terminal and the second reference voltage terminal, respectively.

6. The power supply time sequence control circuit according to claim 1, wherein the output sub-circuit comprises a switching transistor and a driving transistor;

a gate electrode of the switching transistor is electrically connected with the delay detection sub-circuit, so as to receive the trigger signal;

a gate electrode of the driving transistor is electrically connected with a second electrode of the switching transistor;

a first electrode of the driving transistor is electrically connected with the first input voltage terminal, so as to receive the first voltage provided by the first input voltage terminal;

a second electrode of the driving transistor is electrically connected with the signal output terminal;

the driving transistor is configured to provide the first voltage provided by the first input voltage terminal to the second electrode of the driving transistor in response to the trigger signal; and the signal output terminal is configured to allow the first voltage at the second electrode of the driving transistor to be outputted from the signal output terminal.

7. The power supply time sequence control circuit according to claim 6, further comprising an auxiliary output sub-circuit, wherein the auxiliary output sub-circuit is electrically connected with the output sub-circuit;

the auxiliary output sub-circuit is further electrically connected with a second input voltage terminal and a second reference voltage terminal;

a first electrode of the switching transistor is electrically connected with the second input voltage terminal, so as to receive a second voltage that is isolated from the first voltage and is provided by the second input voltage terminal;

the second electrode of the switching transistor is electrically connected with the second reference voltage terminal, so as to receive a second reference voltage that is isolated from a first reference voltage and is provided by the second reference voltage terminal; and the second electrode of the driving transistor is further electrically connected with the second reference voltage terminal.

8. The power supply time sequence control circuit according to claim 7, wherein the output sub-circuit further comprises: a third resistor, a fourth resistor and a fifth resistor;

two terminals of the third resistor are electrically connected with the second input voltage terminal and an output terminal of the delay detection sub-circuit, respectively;

two terminals of the fourth resistor are electrically connected with the output terminal of the delay detection sub-circuit and the gate electrode of the switching transistor, respectively; and two terminals of the fifth resistor are electrically connected with the second electrode of the switching transistor and the second reference voltage terminal, respectively.

9. The power supply time sequence control circuit according to claim 1, wherein the delay control sub-circuit is electrically connected with a first reference voltage terminal;

the delay control sub-circuit comprises an adjustable resistor and a ninth capacitor;

a first terminal of the adjustable resistor is electrically connected with the first input voltage terminal, and a second terminal of the adjustable resistor is electrically connected with a first terminal of the ninth capacitor; and a second terminal of the ninth capacitor is electrically connected with the first reference voltage terminal.

10. The power supply time sequence control circuit according to claim 1, wherein the delay detection sub-circuit is further electrically connected with a first reference voltage terminal;

the delay detection sub-circuit comprises a comparator, a sixth resistor, a seventh resistor, an eighth resistor and a tenth capacitor;

a positive input terminal of the comparator is electrically connected with the delay control sub-circuit, a negative input terminal of the comparator is electrically connected with a first terminal of the eighth resistor, and an output terminal of the comparator is electrically connected with the output sub-circuit;

a second terminal of the eighth resistor is electrically connected with a first terminal of the sixth resistor and a first terminal of the seventh resistor;

a second terminal of the sixth resistor is electrically connected with the first input voltage terminal;

a second terminal of the seventh resistor is electrically connected with the first reference voltage terminal; and two terminals of the tenth capacitor are electrically connected with the first reference voltage terminal and the first input voltage terminal.

11. A display driver circuit, comprising at least one power supply time sequence control circuit according to claim 1.

12. The display driver circuit according to claim 11, wherein the display driver circuit further comprises a power management chip;

the power management chip comprises an input terminal and a plurality of voltage output terminals;

the power management chip is configured to generate a plurality of output voltages based on an initial voltage received by the input terminal;

the plurality of voltage output terminals are configured to output a plurality of output voltages, respectively; and one of the plurality of voltage output terminals of the power management chip is electrically connected with the first input voltage terminal of the at least one power supply time sequence control circuit.

13. The display driver circuit according to claim 12, wherein the at least one power supply time sequence control comprises a plurality of power supply time sequence control circuits;

the plurality of voltage output terminals of the power management chip are electrically connected with first input voltage terminals of the plurality of power supply time sequence control circuits, respectively, so as to provide the plurality of output voltages to the first input voltage terminals of the plurality of power supply time sequence control circuit, respectively; and the plurality of power supply time sequence control circuits are configured to control power supply time sequences of the plurality of output voltages.

14. The display driver circuit according to claim 12, wherein the display driver circuit further comprises a timing controller, a source driver and a gate driver;

the signal output terminal of the at least one power supply time sequence control circuit is electrically connected with one selected from the group of the timing controller, the source driver or the gate driver; and the timing controller, the source driver or the gate driver is further electrically connected with a first reference voltage terminal.

15. The display driver circuit according to claim 11, wherein the display driver circuit further comprises a source driver, and a gray scale voltage generator that is configured to generate a plurality of gray scale reference voltages;

the gray scale voltage generator comprises a plurality of gray scale reference output terminals, and each of the gray scale reference output terminals is configured to output one of the plurality of gray scale reference voltages;

one of the plurality of gray scale reference output terminals of the gray scale voltage generator is electrically connected with the first input voltage terminal of the at least one power supply time sequence control circuit;

the signal output terminal of the at least one power supply time sequence control circuit is electrically connected with the source driver; and the source driver is further electrically connected with a first reference voltage terminal.

16. A display device, comprising the display driver circuit according to claim 11.

17. The display device according to claim 16, wherein the display device further comprises a display panel, and the display panel comprises a common electrode layer;

the first input voltage terminal of the at least one power supply time sequence control circuit is electrically connected with a voltage output terminal, that is configured to output a common voltage, of the power management chip; and the signal output terminal of the at least one power supply time sequence control circuit is electrically connected with the common electrode layer.

18. A method of controlling the power supply time sequence control circuit according to claim 1, comprising:

outputting, by the delay control sub-circuit, the first voltage outputted by the first input voltage terminal after delaying for the pre-determined time period;

sending, by the delay detection sub-circuit, the trigger signal to the output sub-circuit upon the first voltage being received by the delay detection sub-circuit;

allowing the output sub-circuit to be in an on-state in response to the trigger signal, and outputting, by the output sub-circuit, the first voltage provided by the first input voltage terminal to the signal output terminal.

* * * * *